US009433555B2

(12) United States Patent
Yuyama et al.

(10) Patent No.: US 9,433,555 B2
(45) Date of Patent: Sep. 6, 2016

(54) MEDICAMENT DISPENSING MACHINE

(75) Inventors: Shoji Yuyama, Osaka (JP); Itsuo Yasunaga, Osaka (JP); Masahiko Kasuya, Osaka (JP); Norifumi Oike, Osaka (JP)

(73) Assignee: YUYAMA MFG. CO., LTD., Toyonaka-shi (JP)

( * ) Notice: Subject to any disclaimer, the term of this patent is extended or adjusted under 35 U.S.C. 154(b) by 385 days.

(21) Appl. No.: 13/806,138

(22) PCT Filed: Jun. 28, 2011

(86) PCT No.: PCT/JP2011/064722

§ 371 (c)(1),
(2), (4) Date: Mar. 11, 2013

(87) PCT Pub. No.: WO2012/002343

PCT Pub. Date: Jan. 5, 2012

(65) Prior Publication Data

US 2013/0168405 A1 Jul. 4, 2013

(30) Foreign Application Priority Data

Jun. 30, 2010 (JP) ..... 2010-149076
Apr. 28, 2011 (JP) ..... 2011-101495

(51) Int. Cl.
*A61J 1/00* (2006.01)
*G07F 11/42* (2006.01)
*G07F 17/00* (2006.01)

(52) U.S. Cl.
CPC ..... *A61J 1/00* (2013.01); *G07F 11/42* (2013.01); *G07F 17/0092* (2013.01)

(58) Field of Classification Search
None
See application file for complete search history.

(56) References Cited

U.S. PATENT DOCUMENTS 4,546,901 A * 10/1985 Buttarazzi ..... 221/10
2002/0000447 A1* 1/2002 Tsuchida ..... 221/258
2007/0262084 A1* 11/2007 Yuyama et al. ..... 221/135
2008/0061071 A1 3/2008 Omura et al.

FOREIGN PATENT DOCUMENTS

JP 04272758 A 9/1992
JP 2818759 B2 10/1998

(Continued)

OTHER PUBLICATIONS

Extended European Search Report in EP Application No. 11800807.7, Issued on Jan. 8, 2015.

*Primary Examiner* — Gene Crawford
*Assistant Examiner* — Kelvin L Randall, Jr.
(74) *Attorney, Agent, or Firm* — Masuvalley & Partners

(57) ABSTRACT

The disclosed device increases the accommodation amount of blister packages and enables smooth dispensing even if a blister package is bent or similar. The device is provided with: a device body (1), a storage container (2) which accommodates blister packages (4) in a stacked state, and a dispensing member (3) which can dispense the accommodated blister package (4). The storage container (2) is provided with an outlet (13), which is formed on the base at one end side thereof, and which is for ejecting the blister package (4), and a biasing means (12) for biasing the accommodated blister packages (4) toward one end side. The dispensing member (3) is provided with a guide part (36) for guiding a side edge part of the blister packages (4), and biases the blister packages (4) toward one end side of the storage container (2).

4 Claims, 29 Drawing Sheets

(56) References Cited * cited by examiner

FOREIGN PATENT DOCUMENTS

| | | | |
|---|---|---|---|
| JP | 2006-109859 | A | 4/2006 |
| JP | 2009-297466 | A | 12/2009 |
| WO | 2010/032479 | A | 3/2010 |

(a)

(b)

(c)

(d)

MEDICAMENT DISPENSING MACHINE

This application is a National Stage application under 35 U.S.C. §371 of International Application Serial No. PCT/JP2011/064722, filed on Jun. 28, 2011, and claims the priority benefit under 35 U.S.C. §119 of Japanese Patent Application No. 2010-149076, filed on Jun. 30, 2010, and Japanese Patent Application No. 2011-101495, filed on Apr. 28, 2011, which are hereby expressly incorporated by reference in their entirety for all purposes.

TECHNICAL FIELD

The present invention relates to medicine dispensing device.

BACKGROUND ART

Conventionally, there is a medicine dispensing device for dispensing blister packages having a configuration in which a blister package is conveyed with the help of a grip unit and cut by a cutter mechanism to enable retrieval of the required quantity of the package sheet (see Patent document 1, for example).

As another medicine dispensing device for dispensing blister packages, there is one having a configuration that enables retrieval of a blister package loaded inside a medicine cassette by sucking it with a suction member (see Patent document 2, for example).

Further, as another medicine dispensing device for dispensing blister packages, there is one having a configuration wherein a grapple member having a hook-shaped action site is forwarded by an endless belt to hook the end tip of a PTP packaging positioned at the very last of the accumulated PTP packaged medicines and to dispense a blister package (see Patent Document 3, for example).

However, in the medicine dispensing device disclosed in Patent document 1, a grip unit is used for retrieving not only a fraction of the blister package but also one full blister package, and therefore, there is a problem of poor retrieving efficiency. Further, since the blister packages are stacked vertically, the space occupied in the height direction increases, and there is a problem of that the quantity and type that can be accommodated is limited.

In the medicine dispensing device disclosed in Patent Document 2, it is not possible to dispense fraction of a blister package.

Further, a blister package may become curved since it is delivered in a form wherein several numbers are bundled together by a rubber band, etc., however, any of the medicine dispensing devices disclosed in any of the above-mentioned patent documents does not have a configuration for suitably dispensing a curved blister package.

Further, in the medicine dispensing device disclosed in Patent Document 3, blister packages are housed such that they are stacked vertically. Therefore, similarly to Patent document 1, the space occupied in the height direction increases, leading to a problem of limitation on the quantity and type that can be accommodated. Further, since a structure of dispensing a blister package in the longitudinal direction is used, there is also a problem that dispensing takes time.

PRIOR ART DOCUMENTS

Patent Documents

Patent document 1: JP Patent Publication No. 2818759

Patent document 2: JP Published Unexamined Application No. 2006-109859

Patent document 3: JP Published Unexamined Application No. 2009-297466

SUMMARY OF THE INVENTION

Problem to be Solved by the Invention

Accordingly, the present invention is intended to provide a medicine dispensing device capable of accommodating a larger quantity of blister packages, and smoothly dispensing blister packages even when a blister package is curved.

Means to Solve the Problem

The present invention, as a means to solve the problems mentioned above, provides a medicine dispensing device including:

a device body; a storage container in which a plurality of blister packages in which medicines are separately packed are accommodated in a stacked state; and a dispensing member movably provided at the device body, the dispensing member moving up to the storage container and dispensing the accommodated blister package, wherein the storage container includes: an outlet formed at one end side for taking out the blister package; and a biasing means that biases the accommodated blister package towards one end side, and wherein the dispensing member includes a guide part for guiding a side edge part of the blister package, wherein the blister package can be biased towards one end side of the storage container by the guide part.

With this configuration, it is possible to not only guide a side edge of a straight blister package, but also a side edge of a curved blister package that is located at top by the guide member of the dispensing member, and this blister package can be biased toward one end of the storage container. Therefore, with the help of the dispensing member, regardless of the degree of deformation of the blister package, it can be smoothly dispensed through the outlet.

It is preferable that the dispensing member includes an elastic piece that is capable of biasing the blister package towards one end side of the storage container, and wherein the guide part for guiding the side edge part of the blister package is provided at an end section of the elastic piece.

With this configuration, it is possible to provide a simple and inexpensive elastic piece having a guide part at the tip. Since the elastic piece itself imparts a biasing force to the blister package, there is no need to separately provide a biasing means. Here, the guide part, for example, can be formed just by cutting and bending a part of the tip section of the elastic piece, and the processing is also very simple.

It is preferable that the dispensing member include a roller part which, when the blister package is taken out through the outlet of the storage container, comes into contact with a next blister package and rotates.

With this configuration, when removing the top blister package from the storage container, the roller will roll to the next blister package, and will not generate a large frictional force in the direction in which the blister package is taken out. Therefore, it is possible to smoothly take out only the top blister package.

It is preferable that the dispensing member includes a locking mechanism that prevents rotation of the roller part that is in contact with the next blister package while the dispensing member is moving in a direction opposite to a direction in which the blister package was taken out after the blister package is taken out through the outlet of the storage container.

With this configuration, when returning the dispensing member to the original position, the roller part is prevented from rotating by the locking mechanism, and therefore, a friction force with the next blister package becomes large. Therefore, even if the next blister package is assumed to move to the outlet at the time of dispense operation by the dispensing member, it can reliably return to the original position and prepare for the next dispensing operation.

It is preferable that the biasing means includes a pushing pad that comes into contact with the blister package, pushes the blister package towards one end side of the storage container, and prevents a positional deviation of the blister package in a direction perpendicular to a pushing direction.

With this configuration, a blister package within the storage container can be pressed in a stabilized state towards one end. In particular, even when two blister packages are remaining, it becomes possible to reliably prevent the last blister package getting dispensed together when dispensing the top blister package.

It is preferable that the storage container includes a pressing piece that guides a side edge part of the blister package biased by the biasing means, and controls a position of the blister package in a dispensing direction.

With this configuration, when blister packages in the storage container are moved sequentially toward one end, it is possible to move them towards the outlet while correcting the positional deviations, and therefore, the subsequent dispense operation can be smoothly performed.

It is preferable that the storage container includes a guide plate that is provided in the vicinity of the outlet, the guide plate guiding the side edge part of the blister package, and wherein the outlet is formed, with respect to the blister package which is pressed towards one end side, in a direction that is perpendicular to the pressing direction, wherein the guide plate includes a curved part and an inclined part, the curved part gradually changing a guide position in a direction opposite to the outlet as the blister package moves towards the pressing direction, and the inclined part being continuous with the curved part and inclining towards the outlet.

With this configuration, the position in a direction perpendicular to the pressing direction of the blister package that is adjacent to this curved part can be shifted, and further, only the top of a blister package can be separated in the inclined section and made to go towards the outlet. Therefore, only the top blister package can be smoothly dispensed from the outlet.

It is preferable that the storage container includes, at an inner end surface at one end side located in a biasing direction by the biasing means, a curved surface depressed in a direction to avoid interference with a curved shape of the blister package.

With this configuration, even if a blister package is largely bent, due to the presence of the curved surface, the position of side edges of a blister package can be corrected to a position where it can be guided by the guide part of the dispensing member.

It is preferable that the storage container includes a guide surface that moves the blister package, which is positioned at the front in a biasing direction by the biasing means, towards a direction opposite to a dispensing direction by the dispensing member.

With this configuration, only the top blister package can be reliably separated from the subsequent blister packages. Therefore, the dispensing operation by a dispensing member can be smoothly performed.

It is preferable that the storage container includes a second guide surface that is continuous with the guide surface and moves the blister package towards a dispensing direction by the dispensing member.

With this configuration, after moving the top blister package in a direction opposite to the dispensing direction by the guide surface, it can be guided to the outlet.

It is preferable to provide the storage container including an opening/closing door that is rotatable between a dispensing position where the blister package can be dispensed from the outlet and a fraction dispensing position where the blister package dispensed from the outlet can be held, wherein the opening/closing door includes a holding piece that can hold the blister package dispensed from the outlet by pressing the blister package against the opening/closing door at the fraction dispensing position, and wherein the holding piece includes a guiding guide part at a location where the blister package is loaded and withdrawn, the holding piece being formed so as to gradually move away from the blister package towards a transport direction of the blister package.

With this configuration, when loading and withdrawing blister packages from the opening/closing door for cutting a fraction of a blister package held in the opening/closing door by a holding piece, even if the blister package is distorted by the cutting operation or the like, the blister package can be smoothly loaded and withdrawn because of the guiding guide part.

It is preferable that the storage container includes a guide part that positions the held blister package by pressing the guide part against the blister package when the opening/closing door is rotated at the dispensing position.

With this configuration, the positional deviation of a blister package held in the opening/closing door can be reliably prevented, and when dispensing a fraction next time, it is possible to smoothly load and withdraw a blister package from the opening/closing door.

It is preferable that a recessed part is formed at a location opposite to the guide part when the opening/closing door is rotated at the dispensing position.

With this configuration, displacement of a blister package held in the open/close door can be prevented with more certainty.

Effect of the Invention

According to the present invention, in addition to providing a guide part to the dispensing member and guiding the side edges of a blister package, since a the blister package is also biased towards one end of the storage container, a blister package can be reliably dispensed irrespective of whether it is bent or not.

BEST MODE FOR CARRYING OUT THE INVENTION

Embodiments according to the present invention will be described below with reference to the accompanying drawings. In the following description, terms indicating specific direction or position (for example, terms includes 'up', 'down', 'side', and 'end') are used if necessary, but they are for facilitating easy understanding of the invention with reference to the drawings, and the technological scope of the present invention is not limited by the meanings of those terms. Also, the following description is merely illustrative in nature, and is not intended to limit the present invention, its application material or its use.

1. Configuration

Figure 1:
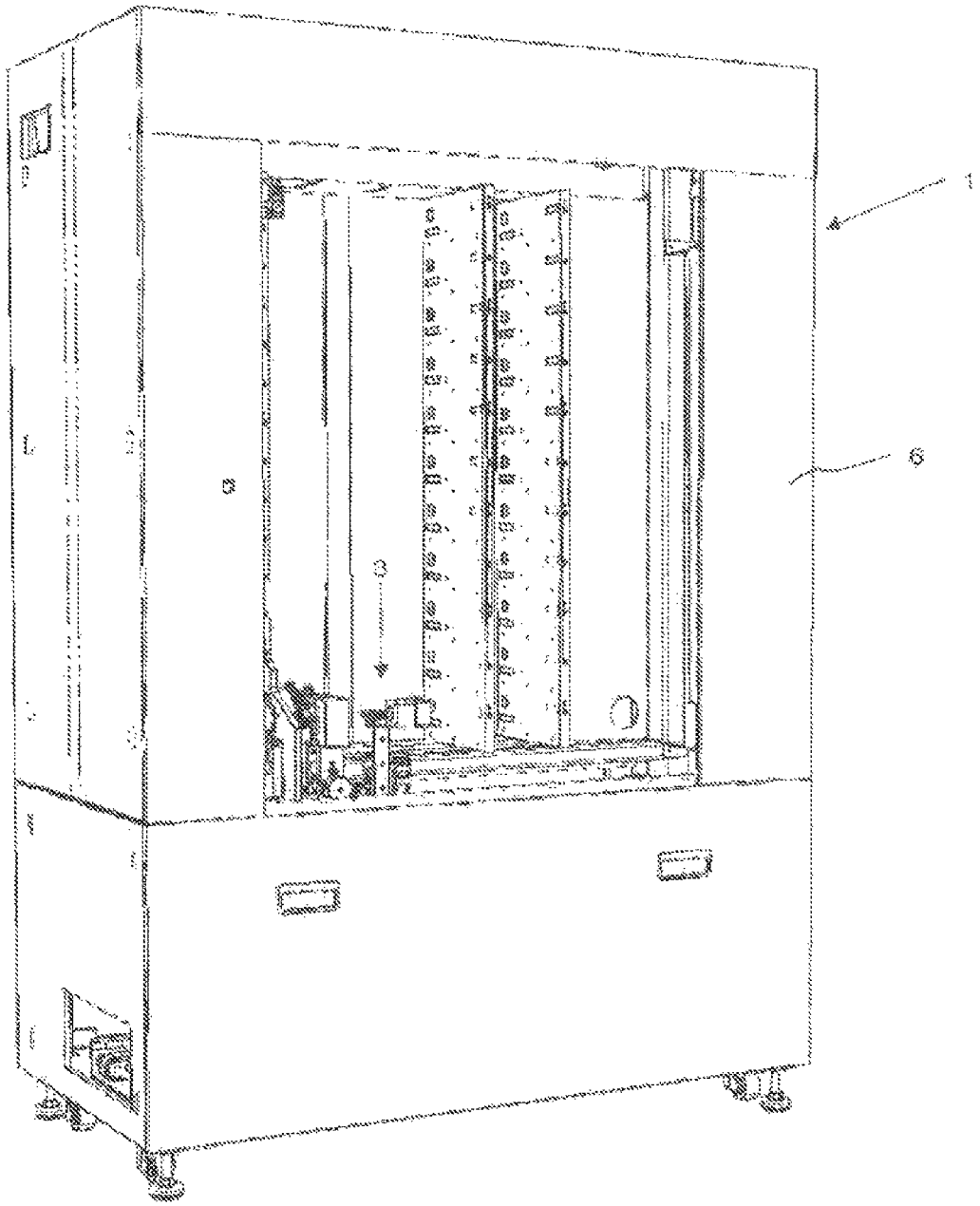
FIG. 1 is a perspective view showing the exterior of a medicine dispensing device according to the present embodiment.
Figure 2:
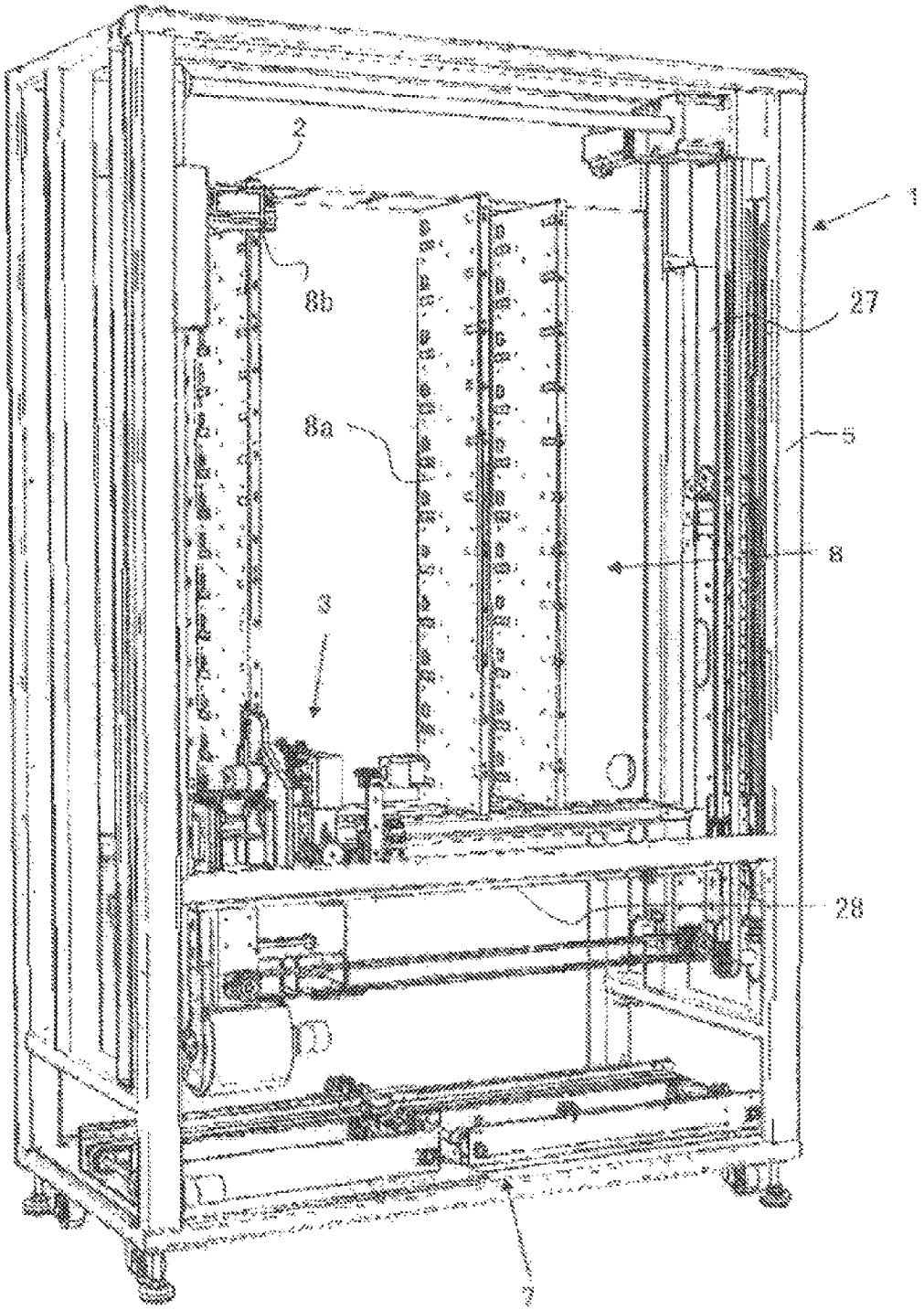
FIG. 2 is a perspective view showing a state in which the exterior panel has been removed from FIG. 1.
Figure 15:
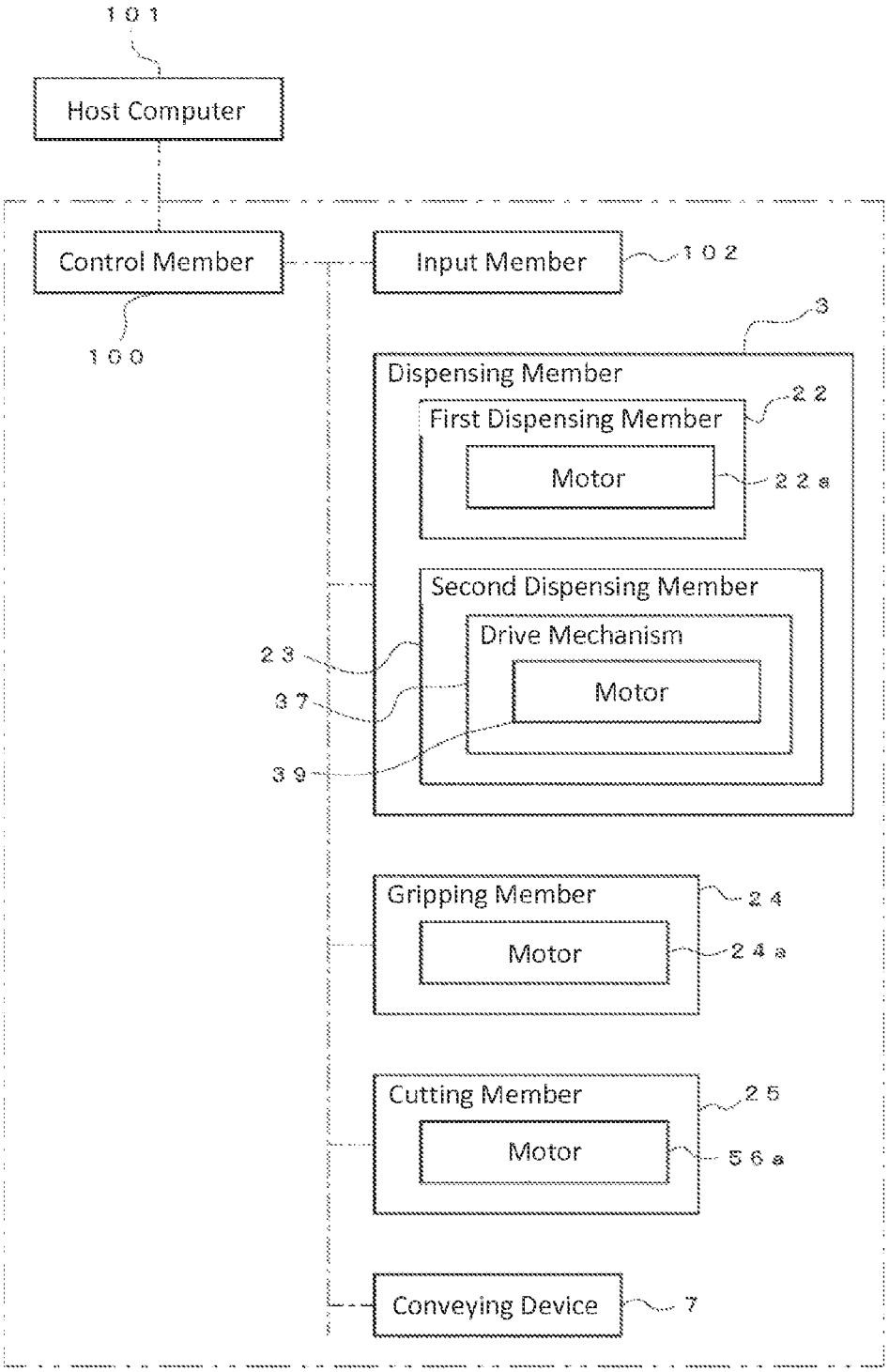
FIG. 15 is a block diagram of a medicine dispensing device according to the present embodiment.

FIG. 1 is a schematic perspective view of a medicine dispensing device according to the present embodiment, and FIG. 2 is a diagram showing a state wherein the exterior panel 6 is removed. This medicine dispensing device is configured such that a plurality of cassettes 2, which are storage containers, are tightly mounted in a grid pattern in the device body 1, and the blister packages 4 in which a plurality of medicine has been packaged (see FIG. 12) are dispensed sequentially from each cassette 2 from a dispensing member 3. Then, the dispensing process of a series of blister packages 4 is executed in a control member 100 (see FIG. 15) based on the prescription data inputted from a host computer or the like, which is not shown.

1-1. Device Body 1

The device body 1, as shown in FIG. 1 and FIG. 2, is formed in a substantially rectangular parallelepiped shape by attaching an exterior panel 6 to the periphery of the frame 5, and a conveying device 7 for conveying a tray, which is not illustrated, is provided in the lower region, and the upper region of the rear half portion serves as a cassette loading portion 8. Here, although a roller conveyor is used as the conveying device 7, it is possible to use various transport means such as belt conveyor, pusher etc. In the cassette mounting part 8, mounting members 8*b* are provided on the opposite faces 8*a* of the support panels disposed at a predetermined distance in left and right directions, it has a configuration wherein cassettes 2 can be inserted and mounted into the mounting members 8*b*.

1-2. Cassette 2

A cassette 2, as shown in FIG. 3 through FIG. 6, is comprised of a substantially rectangular parallelepiped shaped cassette body 9 that is open at top, and an opening/closing door 10 disposed on the front surface of the cassette body 9.

Figure 3:
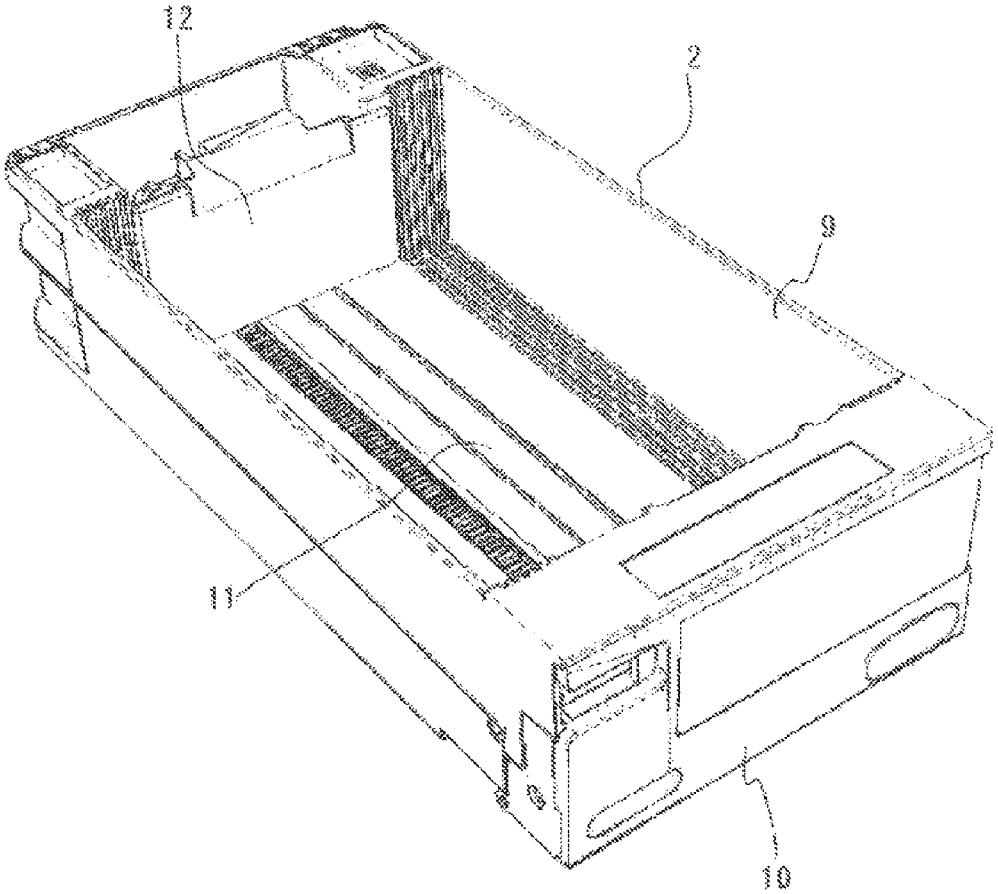
FIG. 3 is a perspective view of a cassette that is mounted in the cassette mounting part of FIG. 2.

As shown in FIG. 3, a guide groove 11 is formed in the bottom surface of the cassette body 9. In the cassette body 9, a pushing member 12 is disposed so as to be able to reciprocate along the guide groove 11. Further, the pushing member 12 can bias blister packages 4 loaded in the cassette body 9 towards the opening/closing door 10 with a constant load by using the constant weight spring (conston), which is not shown, regardless of the change of position.

Figure 5:
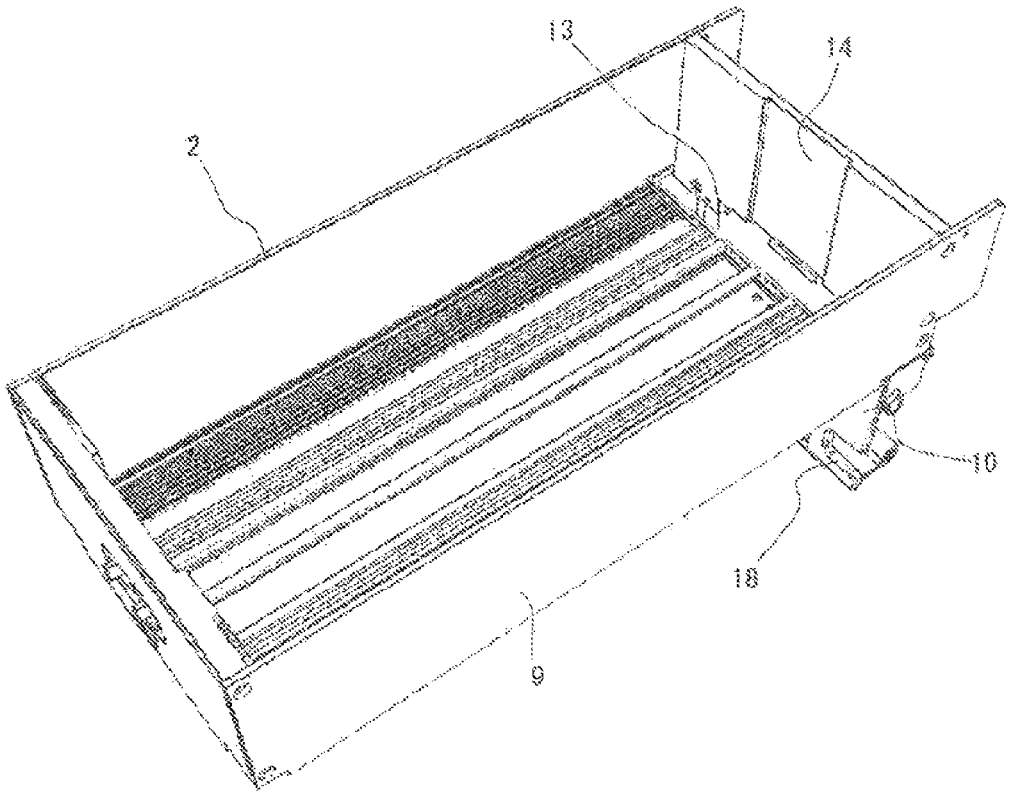
FIG. 5 is a perspective view showing FIG. 4 viewed from a different direction.

Further, in the front end portion of the cassette body 9, as shown in FIG. 5, an outlet 13 is formed in the bottom surface to facilitate retrieval of a top blister package 4. The outlet 13 is partially closed by a closure piece (not shown) provided rotatably in the center of the front end portion on bottom surface so that the falling off of the top blister package 4 is prevented. The closure piece is biased in the closing direction by a spring (not shown).

As shown in FIG. 5, in the front plate 9*a* of the cassette body 9, a recess 14 is formed extending vertically in the middle section of the inside. This recess 14, as explained later, is an escape to facilitate moving of the pressing part 30 when retrieving the top blister package 4.

Figure 12:
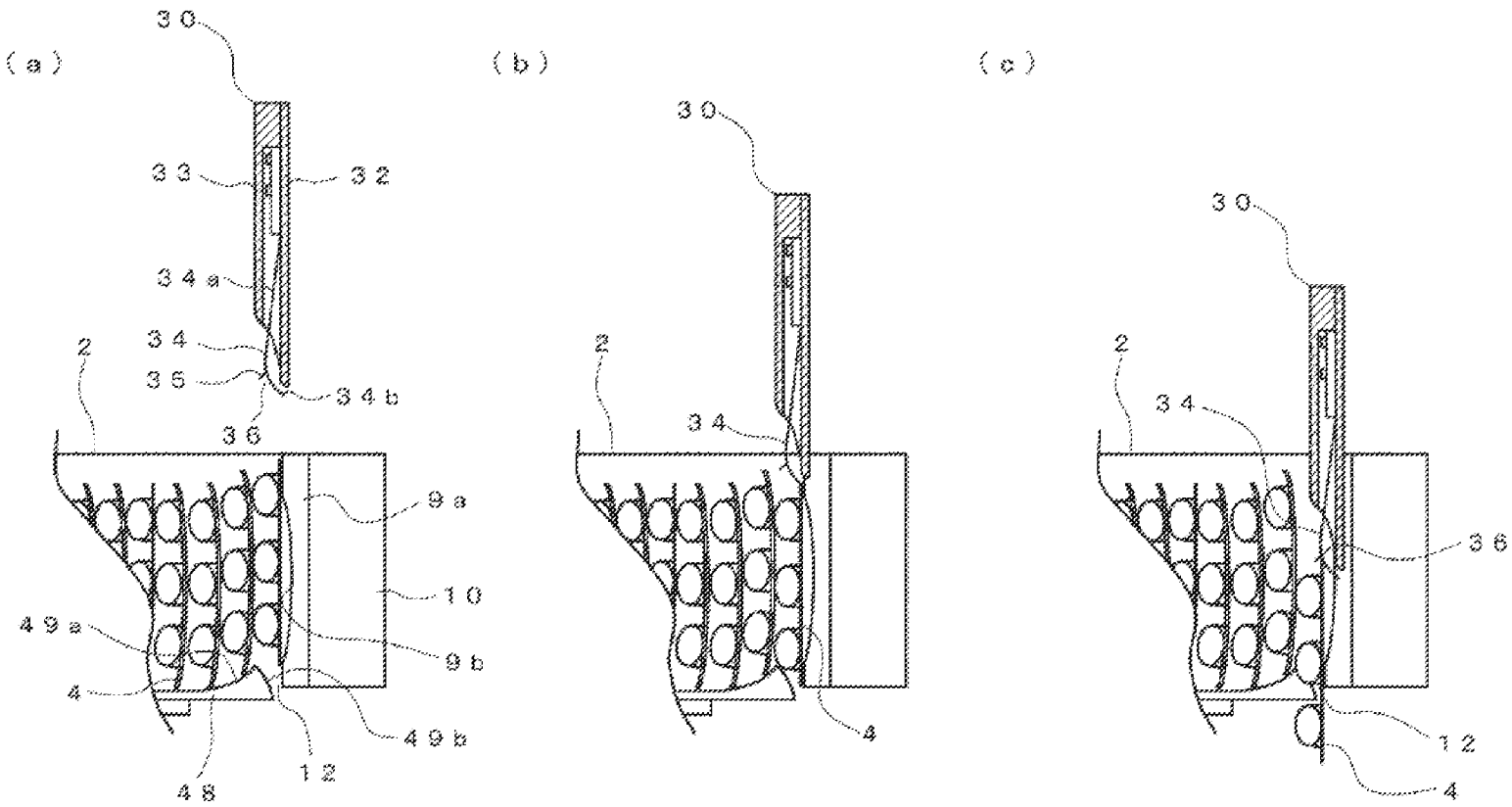
FIG. 12 is a schematic side view showing a dispensing operation of dispensing a straight blister package for a fraction from the cassette by the pressing part of FIG. 11.

In the front plate 9*a* of the cassette body 9, as shown in FIG. 12 (*a*), on both sides of the inner side (on both sides of the recess 14 as shown in FIG. 5), it is preferable to provide a curved surface 9*b* that is depressed towards the front side most in the middle part of the vertical direction. With this configuration, even if a blister package 4 housed in the cassette body 9 is curved, its contact position with front plate 9*a* can be oriented towards front side by the curved surface 9*b*. In other words, even if a blister package 4 is curved, it is possible to fix the position of its upper edge so that it is not positioned largely away from the front plate 9*a*. Therefore, even in case of a curved blister package 4, it is possible to smoothly push it down by the pressing part 30 of the dispensing member 3, which is described later.

At the bottom of the cassette body 9, it is preferable to provide guide plate 48 on both sides in the front part (two places in the width direction) as shown in FIG. 12 (*a*). The guide plate 48 is provided with a first curved surface 49*a* that gradually projects upwards towards the front plate 9*a*. From the first curved part 49*a* to the tip section, a second curved surface 49*b* (guiding surface) is formed as a protrusion. The second curved surface 49*b* guides a blister package 4 sliding through that place to the outlet 13, and in addition, in case this blister package 4 is curved in the transverse direction, it will exert a force in a direction so as to straighten it. It is possible to adjust the position of the guide plate 48 in the width direction (in FIG. 12(*a*), direction perpendicular to space). With this, the guide plate 48 can be positioned between multiple pockets that contain the medicine of the blister package 4. Moreover, the guide plate 48 is attached so as to provide only a small gap between the guide plate 48 and the front plate 9*a* such that only one sheet part (a flat area provided with a cover film, as described later) of a blister package 4 can pass through. With this, the lower edge of a blister package 4 positioned near the outlet 13 can be reliably supported, and dispensing of overlapped blister packages 4, or occurrence of clogging can be prevented. In addition, the above-mentioned front closure piece or the like can be eliminated.

Figure 4:
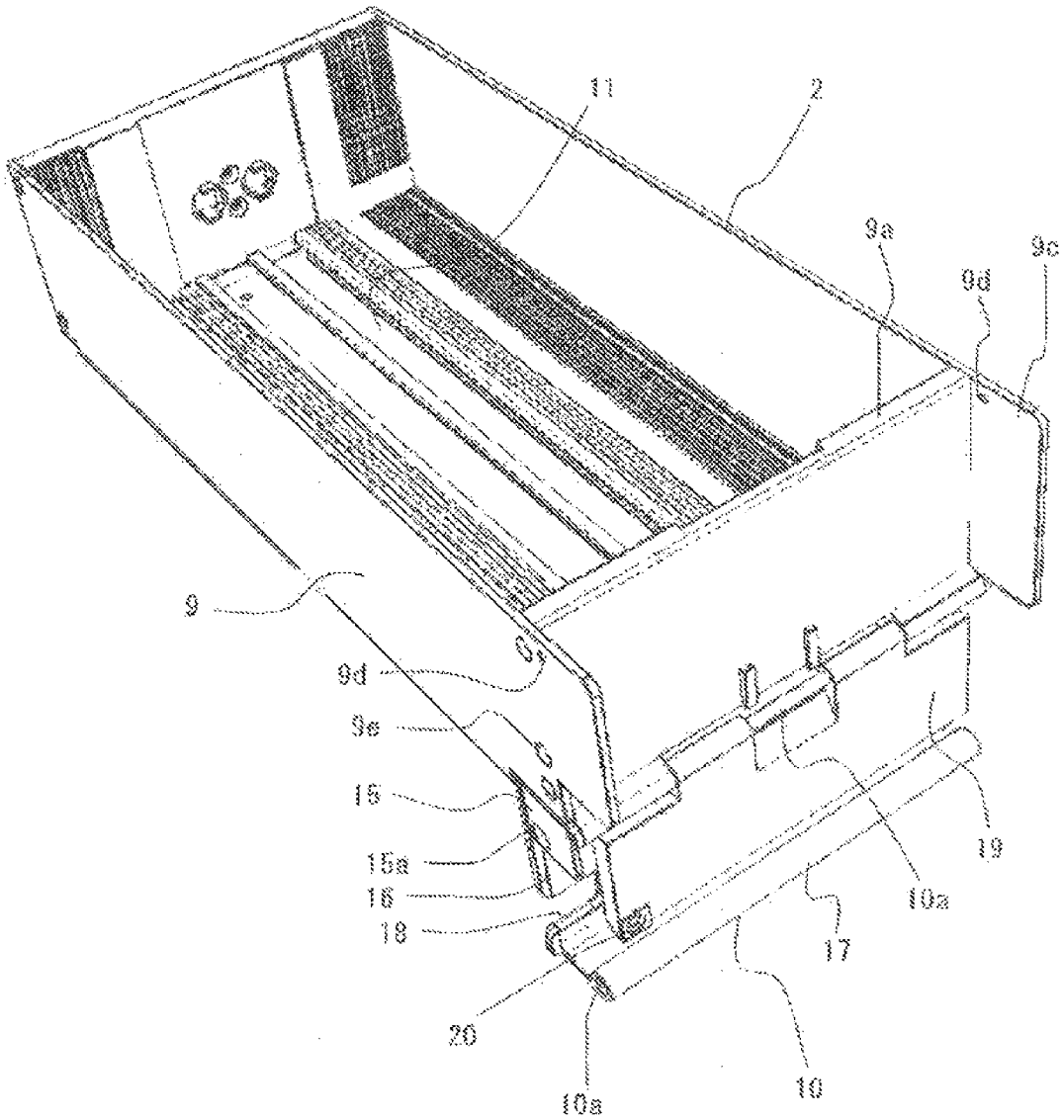
FIG. 4 is a perspective view showing a state in which the opening/closing door is rotated to fraction dispensing position from FIG. 3.

As shown in FIG. 4, on both sides of the cassette body 9, a guide surface part 9*c* projecting further forward from the front surface is provided. In each guide surface part 9*c*, a lock hole 9*d* is respectively formed in opposite positions, and a locking projection (not shown) attached to the recessed part 10*a* of the opening/closing door 10 can be respectively engaged/disengaged. Thereupon, when the opening/closing door 10 is rotated to closed position, the locking projection (not shown) locks with the lock hole 9*d*, and the opening/closing door 10 can be positioned at the closed position. Also, a guide hole 9*e* is formed in one of the guide surface parts 9*c*, and the guide pin 46 of the drive mechanism 37, which is described later, can be engaged/disengaged.

In a cassette body 9, as shown in FIG. 12(*a*), a plurality of blister packages 4 (PTP (Press Through Package) sheets) are stacked and arranged laterally. A blister package 4, although the detail is not illustrated, consists of a plurality of pockets for containing medicine, and has a cover film attached so as to cover the pockets. Regarding the stacking direction of blister packages 4, the cover film side will orient toward the front side of the cassette body 9.

Figure 6:
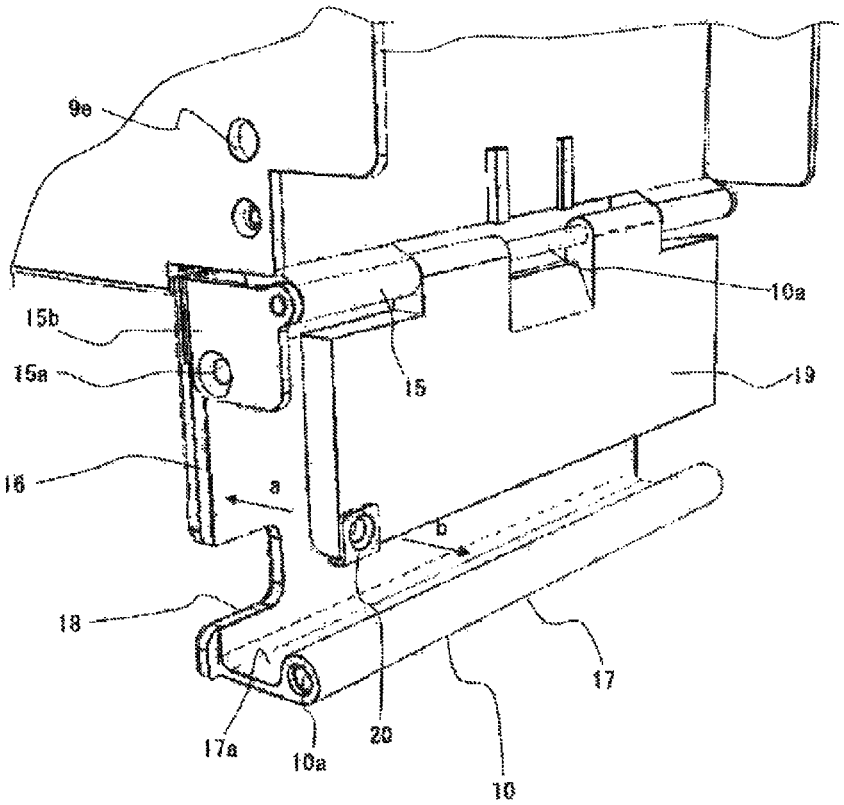
FIG. 6 is an enlarged perspective view of the opening/closing door of FIG. 4.

The opening/closing door 10, as shown in FIG. 6, is attached at the front side lower end of the cassette body 9 so as to be rotatable around a spindle 10*a*. The opening/closing door 10 is comprised of a bearing part 15 attached rotatably to the spindle 10*a*, a front surface portion 16 extending from this bearing part 15, and a guide reception part 17 that projects from the front edge of this front surface portion 16 at right angles.

The bearing part 15, at its one end, is integrated with an end surface 15*b* provided with an operation hole 15*a* in which the rotating pin 43 of a dispensing member 3, which is described later, can engage or disengage. The front surface portion 16 is a flat plate, and in the middle of its one side is provided with a notch portion 18. Using this notch portion 18, a fraction of a blister package 4 can be gripped by a gripping member 24, which is described later. The guide reception part 17 has a reference surface 17*a* wherein the side edge (lower edge) of a fraction (remainder) of the blister package 4 comes in contact and positioned. The tip edge of the guide reception part 17 folded in U-shape is formed in a circular cross-sectional shape, and a recess 10*a* is formed at the both ends, and the recesses are provided with a locking projection (not shown) that locks with the lock hole 9*b* of the guide surface 9*a* when the opening/closing door 10 is positioned at the closed position.

It is possible to position the opening/closing door 10 at the normal dispensing position (FIG. 3) wherein it is rotated to the front end of the cassette body 9 by engaging the rotating pin 43 of the dispensing member 3 with the operation hole 15*a*, and at the fraction dispensing position (FIG. 4) wherein this closed position is rotated by 180 degree. By making the lower edge of the blister package 4 contact the reference surface 17*a* when the opening/closing door 10 is rotated to fraction dispensing position, the blister package 4 can be positioned with respect to the reference surface 17*a*.

The holding piece 19 is rotatably attached to the spindle 10*a*. The holding piece 19 is biased towards the front surface portion 16 (in FIG. 6, shown in the direction of the arrow a) by a coil spring (not shown) attached to the spindle 10*a*. With this, it is possible to hold a blister package 4 by sandwiching it between the front surface portion 16 and the holding piece 19. An attracted part 20 made of a magnetic material is integrated at lower end of an edge of the holding piece 19. Thereupon, when the attracted part 20 is attracted by a magnet 52, which is described later (see FIG. 7), the holding piece 19 is rotated in the direction of the arrow b in FIG. 6 so as to become almost parallel to the front surface portion 16, and the holding state of the blister package 4 is released. Here, the blister package 4, by contacting its lower edge with the reference surface 17*a*, will be positioned in the vertical direction.

In addition, although not shown, a magnetic part and a light emitting part are provided in the front surface of the cassette. When pulling out a cassette 2 from the cassette mounting part 8, this magnetic part is attracted by an electromagnetic part (not shown) provided on a support plate 21, which is described later. Light from the LED (not shown) provided in the device body 1 side is emitted to the light emitting part. The light emitting part is illuminated by LED when notifying a missing part or abnormality of the medicine, for example. With this, the electrical accessories or wiring in the cassette 2 becomes unnecessary, and the configuration can be simplified so that manufacturing at a lower cost is possible.

1-3. Dispensing Member 3

Figure 8:
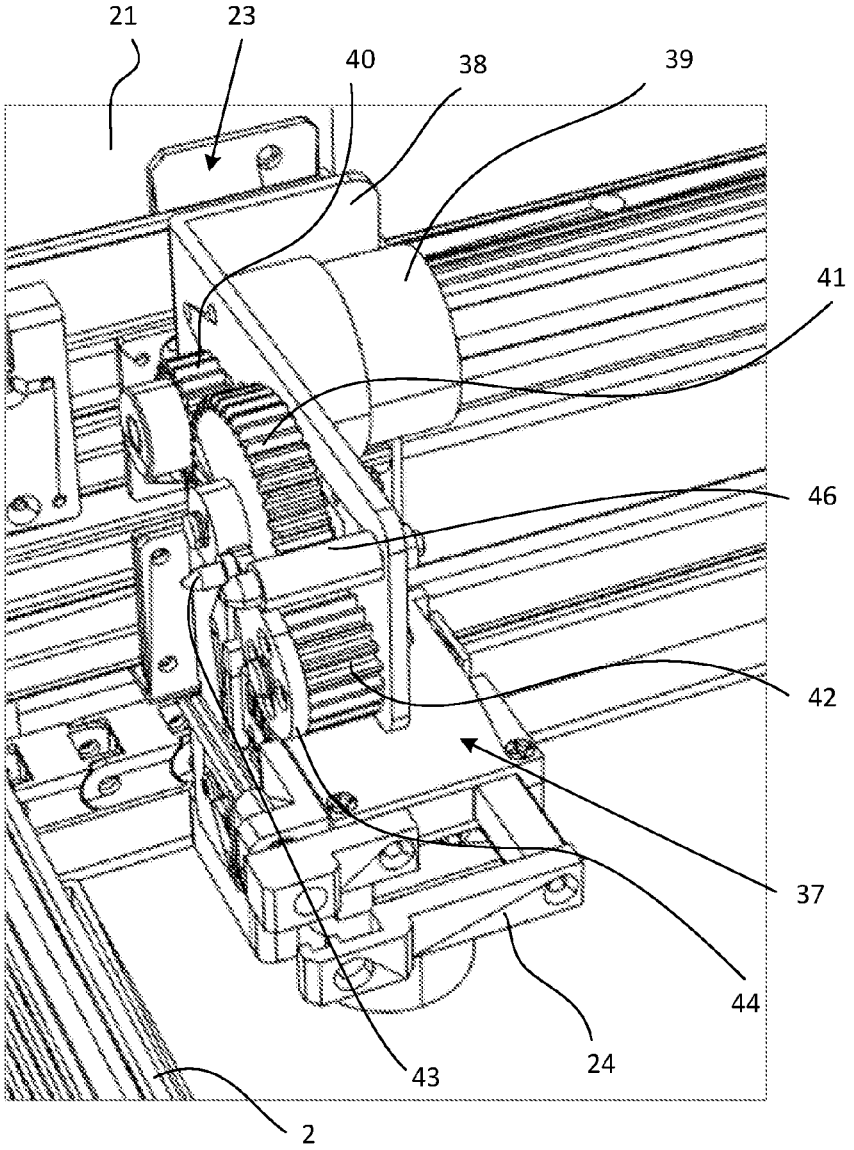
FIG. 8 is a perspective view of a drive mechanism to open/close the opening/closing door of FIG. 4.
Figure 9:
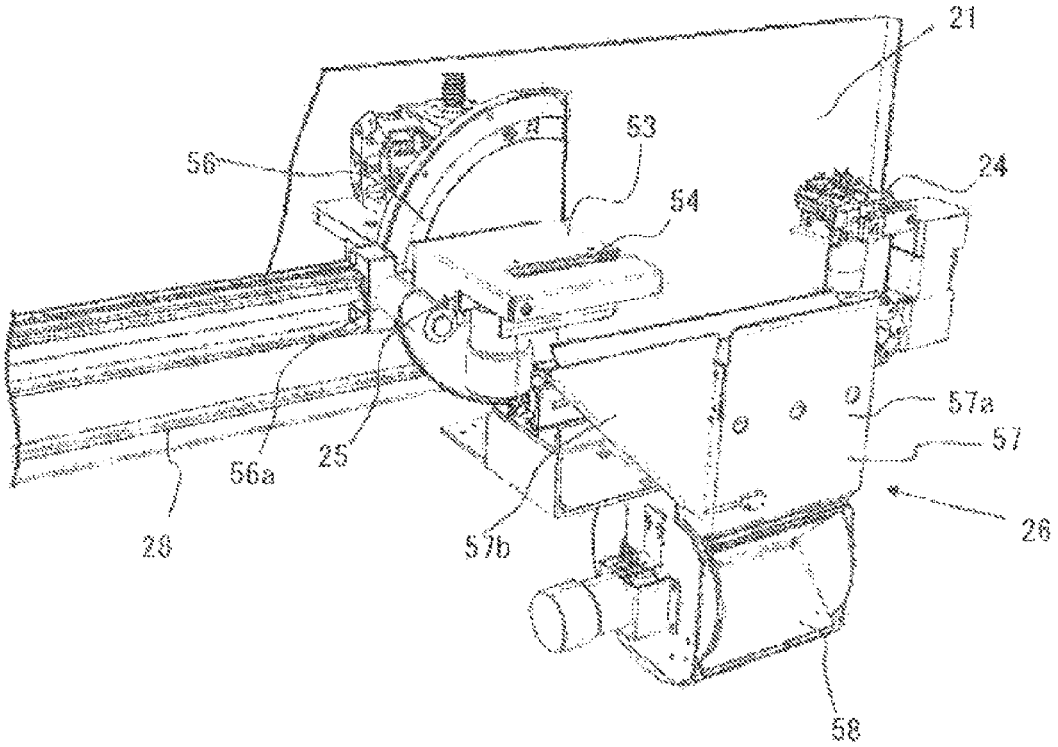
FIG. 9 is a perspective view showing, among the dispensing members of FIG. 1, the gripping member, cutting member and recovery member attached to support plate.
Figure 10:
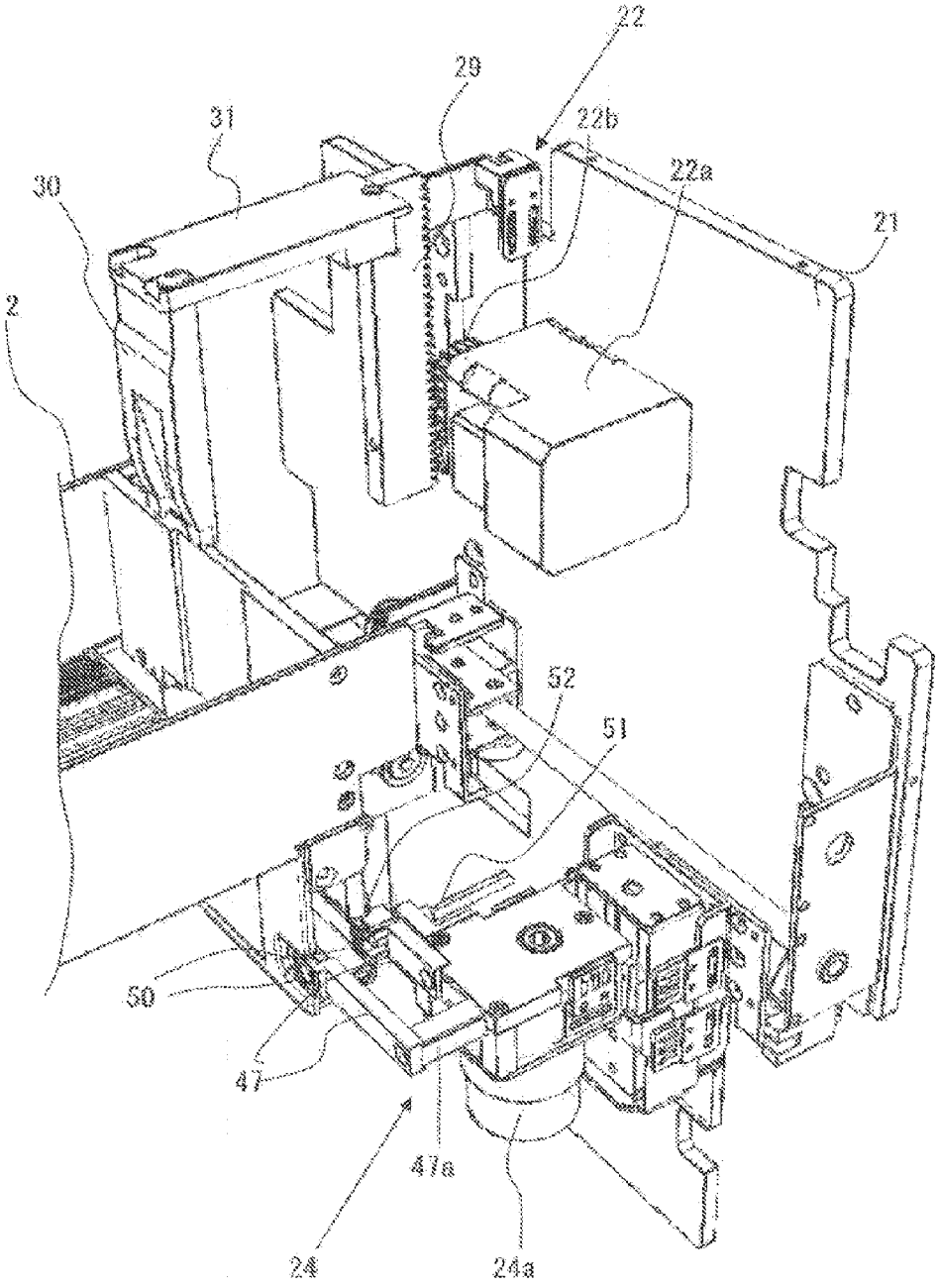
FIG. 10 is a perspective view showing, among the dispensing members of FIG. 1, the gripping member, first dispensing member, and second dispensing member attached to support plate.

The dispensing member 3, as shown in FIG. 8 through FIG. 10, is a support plate 21 provided with a first dispensing member 22, a second dispensing member 23, gripping member 24, cutting member 25 and a recovery member 26. The support plate 21, as shown in FIG. 2, is installed so as to be able to reciprocate on a horizontal rail 28 that can be raised/lowered with respect to a vertical rail 27 disposed at left and right on the front surface of the device body 1.

The first dispensing member 22, as shown in FIG. 10, is formed such that by engaging a rack 29 with a gear 22*b* provided in the rotating shaft of motor 22*a* and rotating a motor 39 in forward/reverse direction, a pressing part 30 integrated with the rack 29 through an arm 31 can be raised/lowered.

Figure 11:
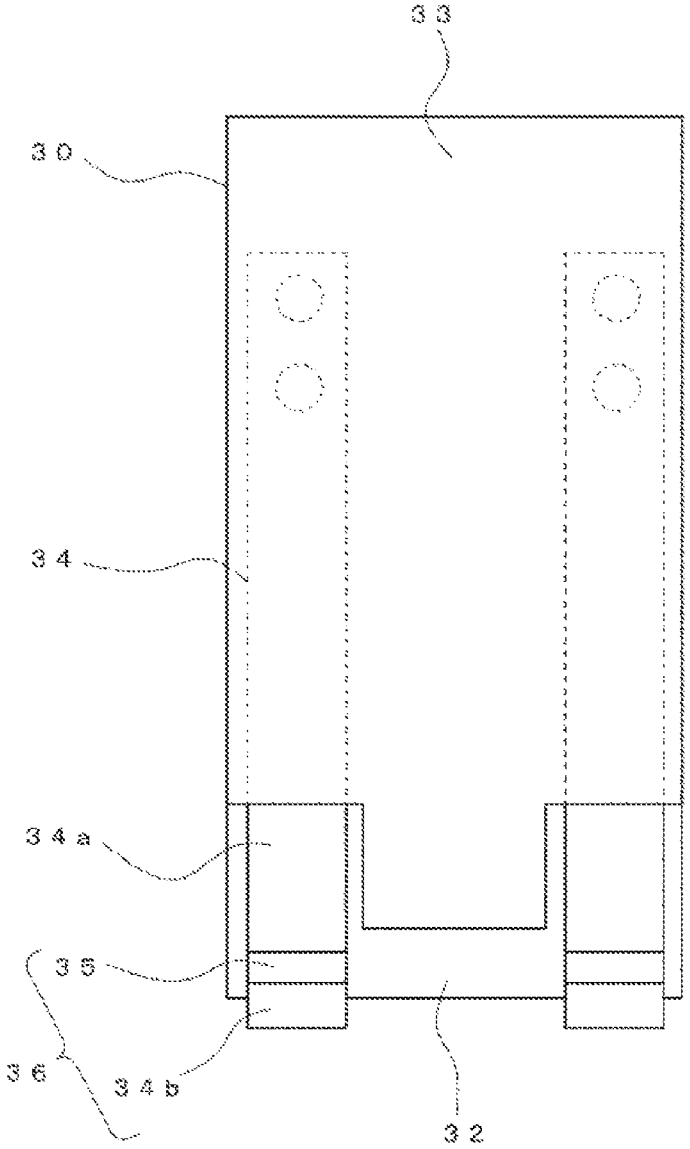
FIG. 11 is a front view depicting the pressing part of the second dispensing member of FIG. 10.

The upper end of the pressing part 30 is screwed to the tip of the arm 31, which is extending horizontally from the rack 29, and extends in the downward direction. Regarding the pressing part 30, as shown in FIG. 11 and FIG. 12, a rear part 33 is integrated on the back of the front plate 32. A gap is formed between the front plate 32 and the rear part 33, and at the upper area on both sides, an elastic piece 34 is fixed respectively. Regarding the rear part 33, the lower end positions of both sides are located higher than the lower end position of the front plate 32, and wherein the lower end part of the elastic piece 34 is exposed. The elastic piece 34 is configured from a linear section 34*a* that gradually slopes towards the rear part 33 in the lower direction from the fixed position, and a curved part 34*b* that curves towards the front plate 32 in the section that is exposed in the lower direction from the rear part 33. A lock piece 35 projects from the curved part 34*b*. The lock piece 35 may be formed by cutting a part of the elastic piece 34, or may be formed by integrally bonding a separate piece or the like. Thereupon, a curved part 34*b* and a lock piece 35 constitute the guide part 36. The guide part 36, as described later, is intended for reliably guiding the top edge portion of the blister package and pushing it down regardless of the blister package 4 being curved or not. In particular, if the side edge of a blister package 4 is distorted so as to bend toward the elastic piece 34, the blister package 4 is biased by the elastic piece 34 and can be pushed down such that the distortion is suppressed. Also, it is preferable that the projection dimension of the lock piece 35 from the curved part 34*b* be almost same as the thickness of the sheet section of the blister package 4. With this, if a blister package 4 that is to be pushed down becomes curved as described above and approaches the adjacent next blister package 4, the lock piece 35 will not interfere with this blister package 4. Thus, according to the configuration of the above-mentioned pressing part 30, the push-down operation of a blister package 4 can be smoothly performed. Furthermore, although two elastic pieces 34 were provided, it is also possible to provide a configuration having only one elastic piece.

The second dispensing member 23, as shown in FIG. 8, is comprised of an electromagnet part (not shown) and a drive mechanism 37.

The electromagnet part is excited through energization, and intended to attract the magnetic part of cassette 2 in the advance position and to draw out the cassette 2 from the cassette mounting part 8 to the medicine retrieving position by retreating.

The drive mechanism 37 is configured such that the driving force of a motor 39 provided in mounting plate 38 having a substantially L-shaped cross section is transmitted to a rotating pin 43 through a gear, and can slide in the width direction according to the size of the cassette 2. Here, corresponding to three types of cassettes 2 of different sizes, it can be positioned at three guide positions and one retracted position.

Followings are the details of the drive mechanism 37. That is, a drive gear 40 is provided in the rotating shaft of the motor 39, an intermediate gear 41 meshes with the drive gear 40, and a driven gear 42 meshes with this intermediate gear 41. A driven plate 44 including a turning pin 43 is integrated with an end of the driven gear 42. The end section of the turning pin 43 can be engaged/disengaged with the operation hole 15*a* formed in the bearing part 15 of the opening/closing door 10. Also, a guide pin 46 that can be positioned in a guide hole 9*e* of the cassette body 9 is integrated with the mounting plate 38. The tip of the guide pin 46 is formed in a cone-shape so as to facilitate easy penetration into the guide hole 9*e*. If the motor 39 is rotated in forward/reverse direction in a state wherein the guide pin 46 is positioned in the guide hole 9*e*, and the turning pin 43 is positioned inside the operation hole 45, the driven plate 44, i.e. the turning pin 43, will rotate via the gear. With this, the opening/closing door 10, positioned by the guide pin 46 and with the spindle 10*a* as center, will rotate respectively to the normal dispensing position and the fraction dispensing position. It is further preferable to provide a torque limiter etc. in any of the power transmission path from motor 39 up to driven plate 44 (to the rotating shaft of the driven gear 42, for example). With this, when rotating the opening/closing door 10 to closed position by the drive mechanism 37, unnecessary load is not applied to the cassette body 9, and damage can be prevented.

Figure 7:
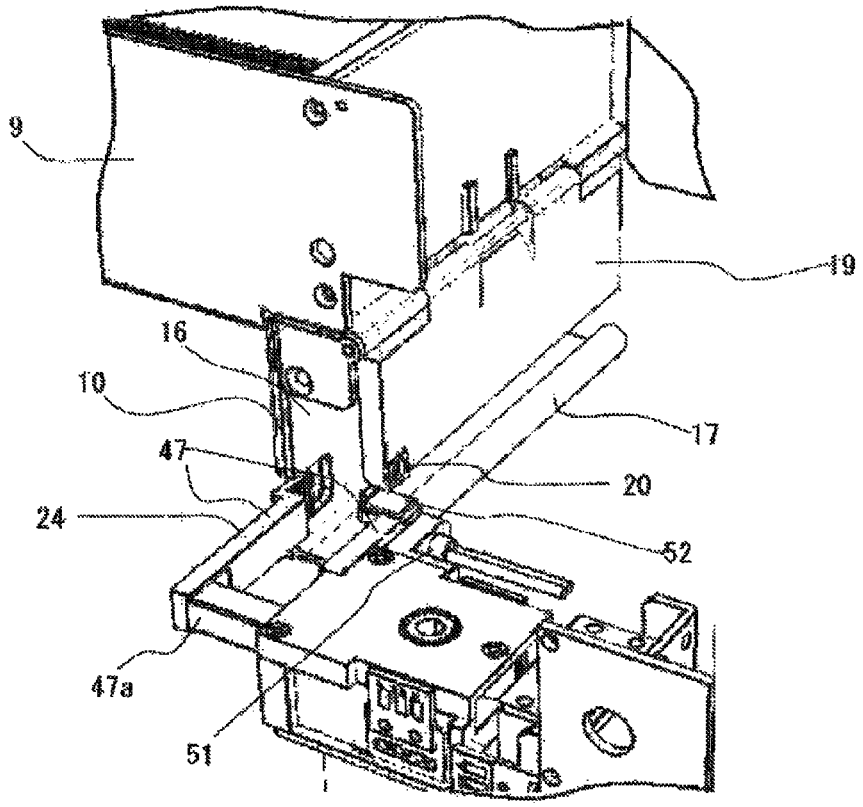
FIG. 7 is a partial perspective view of an opening/closing door and gripping member of FIG. 4.

The gripping member 24, as shown in FIG. 7 and FIG. 10, consists of a pair of gripping pieces 47. The gripping piece 47 is installed in the front part of the support plate 21 such that it can reciprocate in the horizontal direction. Thereupon, by conveying the driving power of motor 24*a*, via a pinion (not shown) provided in its rotating shaft, to a rack (not shown) formed on opposite faces of an arm 47*a* extending from each gripping piece 47 (one is not shown), opening/closing is done. Also, one end (free end) of each gripping piece 47 is bent in the form of a crank to form mutually facing gripping parts 50. A through-hole is formed in each gripping part 50 respectively, and with the help of a light sensor 51 provided in one of the gripping pieces 47, it is possible to detect through the through-hole as to whether a blister package 4 is being held or not. In addition, a magnet 52 (here, a neodymium magnet is used) is provided to one of the gripping pieces 47. This magnet 52 is intended for attracting an attracted part 20 provided in the holding piece 19 of the opening/closing door 10, and rotating this holding piece 19 to separate it from the front surface portion 16.

In the cutting member 25, as shown in FIG. 9, a pair of cutting blades 55 (see FIG. 14) that can be contacted/separated across a gap 54 is provided in the fulcrum 53. One end of the fulcrum 53 is fixed to a fan-shaped rotating plate 56 that functions as a position adjustment member. A gear is formed in the outer peripheral edge of the rotating plate 56. This gear meshes with a gear provided in the rotating shaft of motor 56*a*. Thereupon, by driving the motor 56*a*, the rotating plate 56 is rotated forward or backward via the gear. With this, the cutting blade 55 is rotated together with the rotating plate 56, and the cutting position of a blister package 4 held by the gripping member 24 is changed. Here, the cutting member 25 is used by positioning it in two locations, namely, horizontal position (FIG. 9) and vertical position. Further, the cutting member 25 is provided with a lifting mechanism, which is not shown, and with which the cutting position of the cutting blade 55 can be adjusted. With this, blister packages 4 having multiple rows can be cut into a fraction of minimum one tablet unit. Moreover, it is preferable to provide a pressing member (not shown) to prevent misalignment of a blister package 4 inserted in the gap of fulcrum 53 to prevent the misalignment of blister packages 4 (flying, jumping etc.) due to impact when cut.

The recovery member 26, as shown in FIG. 9, is provided with a guiding path 57 and a recovery container 58. The guiding path 57 is configured from a straight part 57*a* and an inclined part 57*b*. A blister package 4 falling from the outlet 13 of the cassette 2 will pass through the straight part 52*a*, and a fraction of the blister packages 4 that were cut by the cutting member 25 will pass through the inclined part 57*b* and join in the straight part 52*a*. The recovery container 58 has three storage compartments (not shown), and a blister package 4 fed via the guiding path 57 is conveyed into each section provided in a tray (not shown) carried by the conveying device 7.

2. Operation

Figure 16:
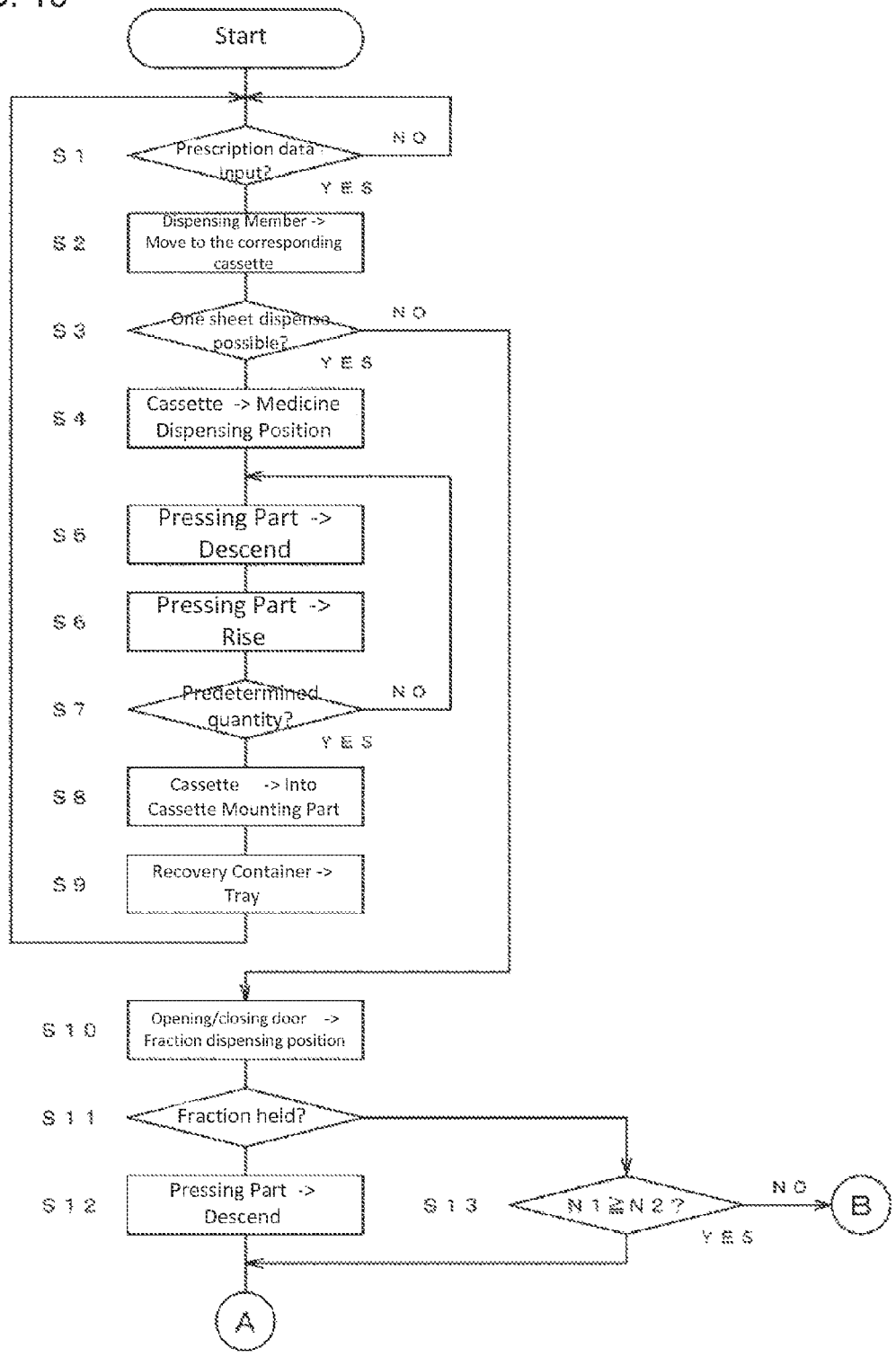
FIG. 16 is a flow chart showing the dispensing process of a medicine by a control member of the medicine dispensing device according to the present embodiment.
Figure 17:
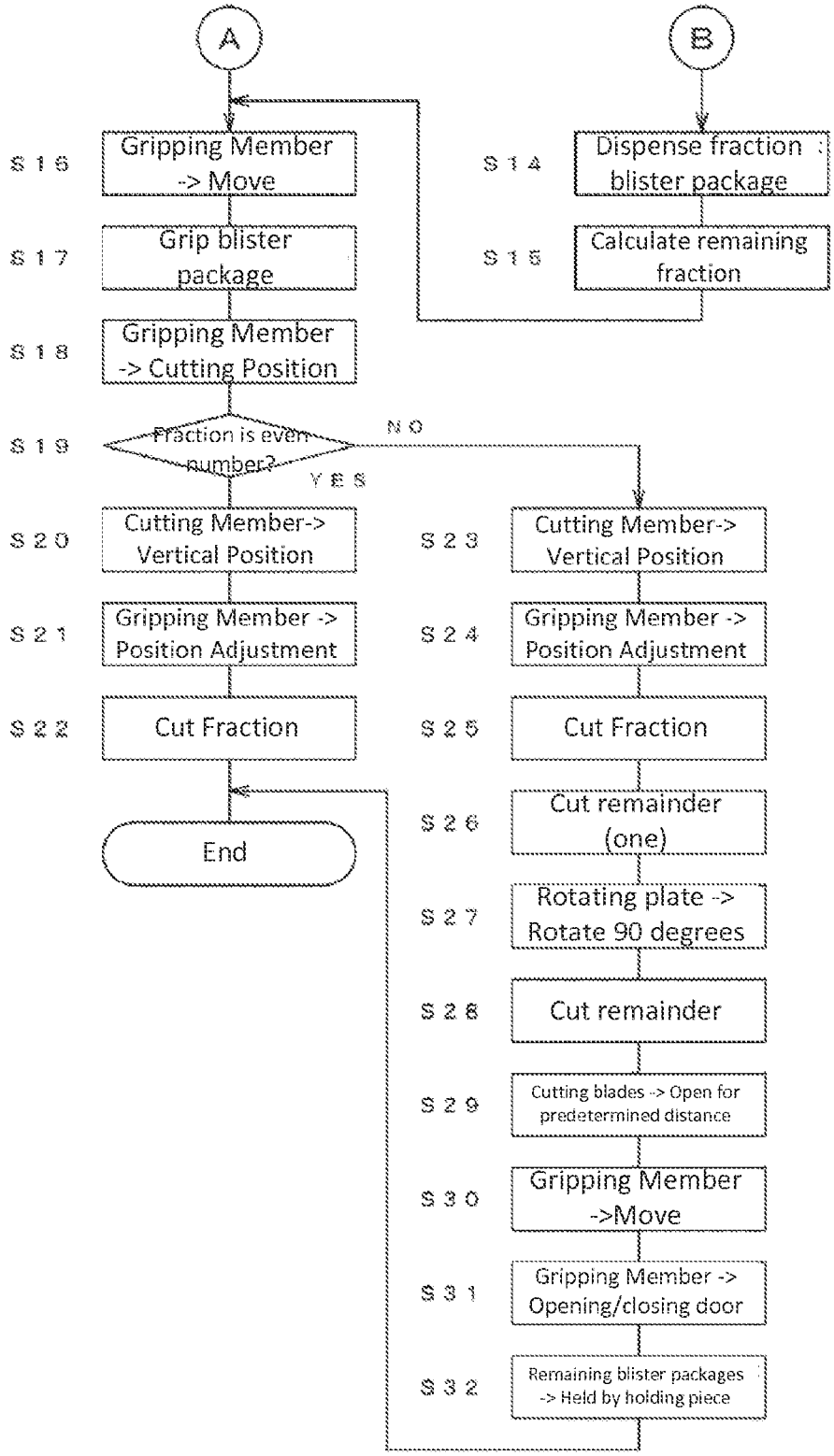
FIG. 17 is a flow chart showing the dispensing process of a medicine by a control member of the medicine dispensing device according to the present embodiment.

Next, the operation of a medicine dispensing device of the configuration described above will be explained with reference to the flowcharts in FIG. 16 and FIG. 17.

When prescription data is input from a host computer (not illustrated) etc. (step S1), based on the input prescription data, the dispensing member 3 is moved to a cassette 2 wherein the blister package 4 of the corresponding medicine has been housed (step S2). Then, it is determined whether a blister package 4 is to be dispensed as one whole sheet or not (step S3). This can be determined based on whether the quantity of a medicine contained in the prescription data is more than the quantity of the medicine contained in one sheet of the blister package 4 or not. Here, how many strips of the blister packages 4 have to be dispensed is calculated. This calculation can be done based on how many times the quantity of the former would be of the quantity of the latter. When dispensing several strips of the blister packages 4, the quantity left over as fraction will be dispensed in processes after the step S10, which are described later.

When one full sheet of a blister package 4 is dispensed (step S3: YES), the support plate 21 is moved, and the electromagnet part is excited. With this, the magnetic part of the cassette 2 is being attracted, and therefore, the support plate 21 is retracted, and the cassette 2 is positioned in the medicine dispensing position (step S4). In this state, as shown in FIG. 12 (*a*), it will assume a state wherein a blister package 4 positioned at top can be pressed down by the pressing part 30 of the dispensing member 3. Then, if the motor 22*a* is driven to move the pressing part 30 downward via gear 22*b* and rack 29 (step S5), as shown in FIG. 12 (*b*), the curved part 34*b* of elastic piece 34 of the pressing part 30 will come in contact with the upper edge of the blister package 4. Thereupon, by contacting the straight part 34*a* of the elastic piece 34 with the rear part 33 of the pressing part 30 and limiting the bending towards rear surface, it is possible to ensure the pressing down operation of the blister package 4. Further, as shown FIG. 12(*c*), when the pressing part 30 is moved downward, the elastic piece 34 will be elastically deformed, and the upper edge of the blister package 4 will be guided by the guide part 36. With this, only the blister package 4 positioned at the top will be smoothly dispensed from cassette 2 via the outlet 13. Also, when a blister package 4 positioned at top is dispensed from the outlet 13, the next blister package 4 biased by a constant force spring will contact the rear part 33, and there will be no interference with the elastic piece 34. Therefore, by smoothly moving the pressing part 30 upwards, it can be smoothly returned to the initial state shown in FIG. 12(*a*).

Figure 13:
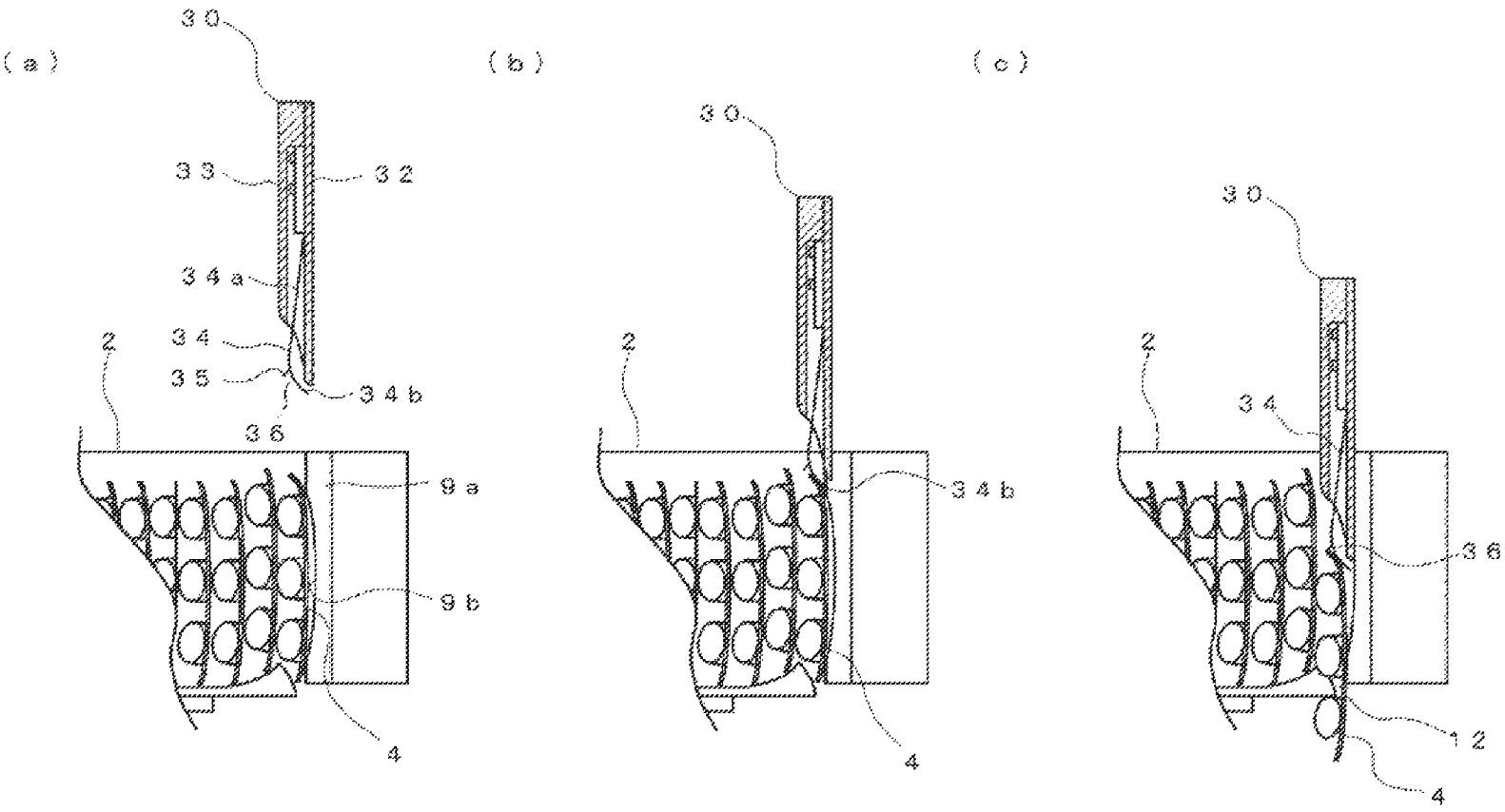
FIG. 13 is a schematic side view showing a dispensing operation of dispensing a bent blister package for a fraction from the cassette by the pressing part of FIG. 11.

Here, several blister packages 4 are often bundled in a rubber band etc., and delivered. Due to this, a blister package 4 set inside cassette body 9 may curve in a direction transverse to the perpendicular side. Regarding the pressing part 30, as described earlier, a guide part 36 is formed at the lower end of the elastic piece 34. Therefore, even if a blister package 4 to be pressed down is assumed to be curved, for example, as shown in FIG. 13(*a*), by moving the pressing part 30 in the lower direction, the upper edge of the top blister package 4 can be always guided by the guide part 36, as shown in FIG. 13 (*b*) to (*c*). Moreover, by the elastic force possessed by the elastic piece 34, the blister package 4 is biased in the direction to correct a curved shape. Therefore, even if a blister package 4 is curved, it can be smoothly dispensed from the cassette 2 through the outlet 13. The dispensed blister package 4 is collected into the recovery container 58 through the guiding path 57. The pressing part 30 is temporarily lifted in order to press down the next blister package 4 (step S6).

Then, it is determined whether or not the quantity of the blister packages 4 dispensed as one whole sheet is same as the predetermined quantity calculated based on the prescription data (step S7). If it is not same as the predetermined quantity, the step is returned to step S5 (step S5), and the push-down operation of lowering the pressing part 30 and returning operation of lifting (step S6) are repeated. If it is same as the predetermined quantity, the dispensing of the blister package 4 is deemed to have been completed, and the cassette 2 is housed in the cassette mounting part 8 by moving the electromagnet part forward (step S8). Then, the recovery container 58 (dispensing member 3) is moved to the tray, which is not shown (step S9).

When a blister package 4 is dispensed in fraction (step S3: NO), the opening/closing door 10 is rotated 180 degree by the turning pin 43 and positioned at the fraction dispensing position (step S10). Then, it is determined whether or not a fraction of a blister package 4 has been held in the opening/closing door 10 (fraction held?) (step S11).

If a fraction of a blister package 4 is not held in the opening/closing door 10 (step S11: YES), a blister package 4 positioned at top is pressed down by the pressing part 30 in the same way as above, and discharged through the outlet 13 (step S12). The discharged blister package 4, with the help of the holding piece 19 that is biased towards the front plate 32 by a coil spring, is sandwiched between the front plate 32 and the holding piece 19.

If a fraction of a blister package 4 is held in the opening/closing door 10, whether the quantity of the medicine N1 is more than the desired quantity N2 to be dispensed as per prescription data (Step S13). If N1≥N2, then steps S16 to S30 (described later) are executed. If N1<N2, after gripping a fraction of the blister package 4 with the gripping member 24 and dispensing it to the recovery container 58 (step S14), the remaining fraction part is calculated (step S15), and this remaining fraction is subjected to steps S16-S30, which are described later.

When dispensing fraction part, the gripping member 24 is brought closer to the opening/closing door 10 (step S16). Subsequently, by moving the gripping pieces 47 away and moving the blister package 4 to a position where it can be gripped, the magnet 52 provided near the gripping member 24 will attract the attracted part 20 provided in the holding piece 19, and as shown in FIG. 7, the holding piece 19 is rotated in a direction away from the front surface portion 16. The blister package 4 will lose the holding by the holding piece 19, and drop till its lower edge touches the guide reception part 17. With this, the blister package 4 can always be positioned in the same position in a vertical direction with respect to the reference surface 17*a* of the guide reception part 17 of the opening/closing door 10. In other words, a blister package 4 can be always positioned immediately before the blister package 4 is gripped by the gripping member 24. However, there is no particular restriction on the timing of rotation of the holding piece 19 by magnet 52 as whether it should occur after cutting by the cutting member 25, etc. Moreover, because the blister package 4 is discharged vertically in the lower direction by the pressing part 30 via the outlet 13 of the cassette 2, there is hardly any misalignment in the horizontal direction.

Thereupon, the gripping member 24 is driven, and through the notch 18 formed in the guide reception part 17, the edge section of the blister package 4 is gripped with the gripping piece 47 (step S17). Here, based on the detection signal in the light sensor 51, the edge section of the blister package 4 is detected, and whether the blister package 4 is surely held by the gripping piece 47 is checked. Then, the gripping member 24 is moved horizontally and positioned at the cutting position of the cutting member 25 (step S18). In the cutting member 25, the rotation position is varied depending on the fraction of the blister package 4.

In case the pockets of a blister package 4 are even number of columns (2 columns or 4 columns), whether the fraction is even number or not is determined (step S19). If the fraction is even number (step S19: YES), the cutting member 25 is vertically positioned by rotating 90 degree (step S20), and by adjusting the position of the gripping member 24, the part to be cut off is positioned to be a desired quantity (step S21). With this, when a blister package 4 is cut laterally by the cutting member 25 (step S22), only the desired fraction can be recovered to the recovery container 58 through the guiding path 57.

If the fraction is an odd number (step S15: NO), after the blister package 4 is cut in the lateral direction as described above (steps S23-S25), one remaining part of the remaining blister package 4 is cut. In this case, after cutting the remaining blister package 4 laterally by only half from the edge in the width direction (step S26), the rotating plate 56 is made to horizontal position by rotating 90 degree (step S27), and only half may be cut in the vertical direction (step S28).

Figure 14:
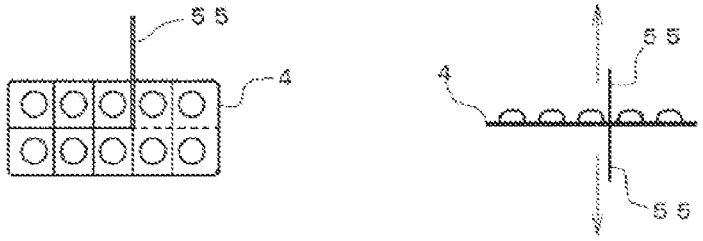
FIG. 14 is an explanatory diagram showing an example of a method of cutting a fraction by the cutting member shown in FIG. 9.
Figure 14:
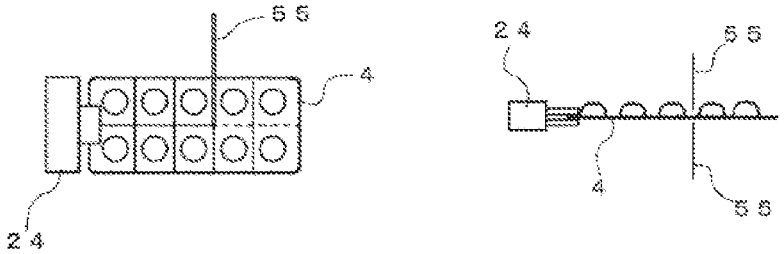
Figure 14:
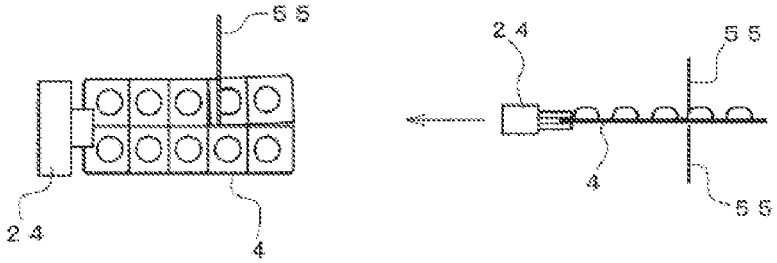
Figure 14:
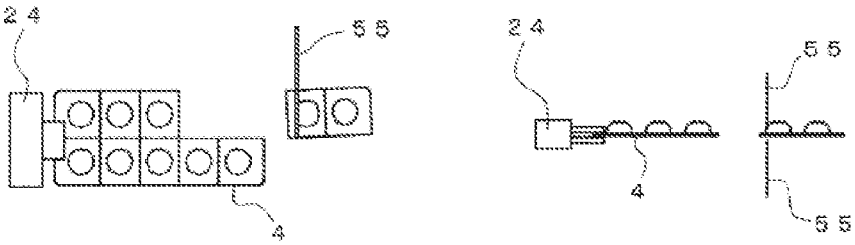

Also, thus, when cutting a blister package 4 half in lateral direction and vertical direction, it may be expected that the package is not separated well in the boundary section of the cutting sites. Therefore, after cutting in the lateral direction as shown in FIG. 14(*a*), the cutting blades 55 are temporarily opened at a predetermined distance, as shown in FIG. 14(*b*) (step S29). Regarding the distance of opening here, the gap between the cutting blades 55 shall be wider than the sheet thickness of the blister package 4, but not to exceed the thickness of the entire body including the pockets. Then, as shown in FIGS. 14 (*c*) and (*d*), by moving the gripping member 24 in the horizontal direction (step S30), even if it is not well separated in the boundary section of the cutting sites, it is possible to detach it forcibly. Moreover, in FIG. 14, although a case of cutting two medicines was illustrated, it is same for one medicine.

Moreover, if the pockets in a blister package 4 are odd number of columns (three columns), depending on if the fraction is even number or odd number, a process reverse to the above may be carried out.

The remaining blister package 4, following cutting of fraction as above, is transported to the guide reception part 17 of the opening/closing door 10 by moving the gripping member 24 (step S31). Then, by releasing the gripping by the gripping member 24, the remaining blister package 4 is held by the holding piece 19 provided in the guide reception part 17 (step S32). In this case, same as the above, a gap is formed by separating the holding piece 19 of the opening/closing door 10 from the front surface portion 16 by the action of the magnet 52. Therefore, just by moving the gripping member 24, the blister package 4 can be smoothly positioned between the front surface portion 16 and the holding piece 19. Therefore, when gripping by the gripping member 24 is released and this gripping member 24 is moved, the holding piece 19 is rotated because of biasing by the coil spring, and the blister package 4 can be sandwiched between the holding piece 19 and the front surface portion 16. Also, if the blister package 4 is sandwiched, the support position by the holding piece 19 may be stored in memory as a coordinate data along with the remaining quantity (number of pockets), and when dispensing the next blister package 4, the gripping member 24 may be moved based on this data to dispense the remaining blister package 4. When the remaining blister package 4 held in the guide reception part 17 is exhausted, new blister package 4 may be discharged from the cassette 2 to the guide reception part 17, and cut in the same way as the above.

Moreover, the pushing direction by the pressing part 30 is not restricted to vertical direction, and horizontal direction is also possible. Further, the pushing direction of the blister package 4 is not restricted to transverse direction, and length direction is also possible. When pushing in the length direction, the edge section of the blister package 4 (plate-like portion that can be detached from the pocket part) may be positioned in the lower direction. When pushing a blister package 4 in the length direction, by rotating the storage direction of the blister package 4 by 90 degree and directing its length direction toward the vertical direction, the short side of the blister package 4 may be pressed down by the pressing part 30, or the pressing part 30 may be rotated by 90 degree to push the blister package 4 in the horizontal direction. According to this, the blister package 4 will not be off balance unlike when pressing both ends of the long side of the blister package 4, and a blister package 4 can be smoothly discharged.

Further, when cutting a fraction from a blister package 4, a process was used wherein the blister package 4 is cut in the lateral direction in case of even number, and in case of odd number, an even number was cut in the lateral direction followed by cutting a remaining one medicine, but it is not restricted to such a cutting method. For example, when cutting two medicines from a two-column blister package 4, it is also possible to cut two medicines from one column as shown in FIG. 14.

Figure 18:
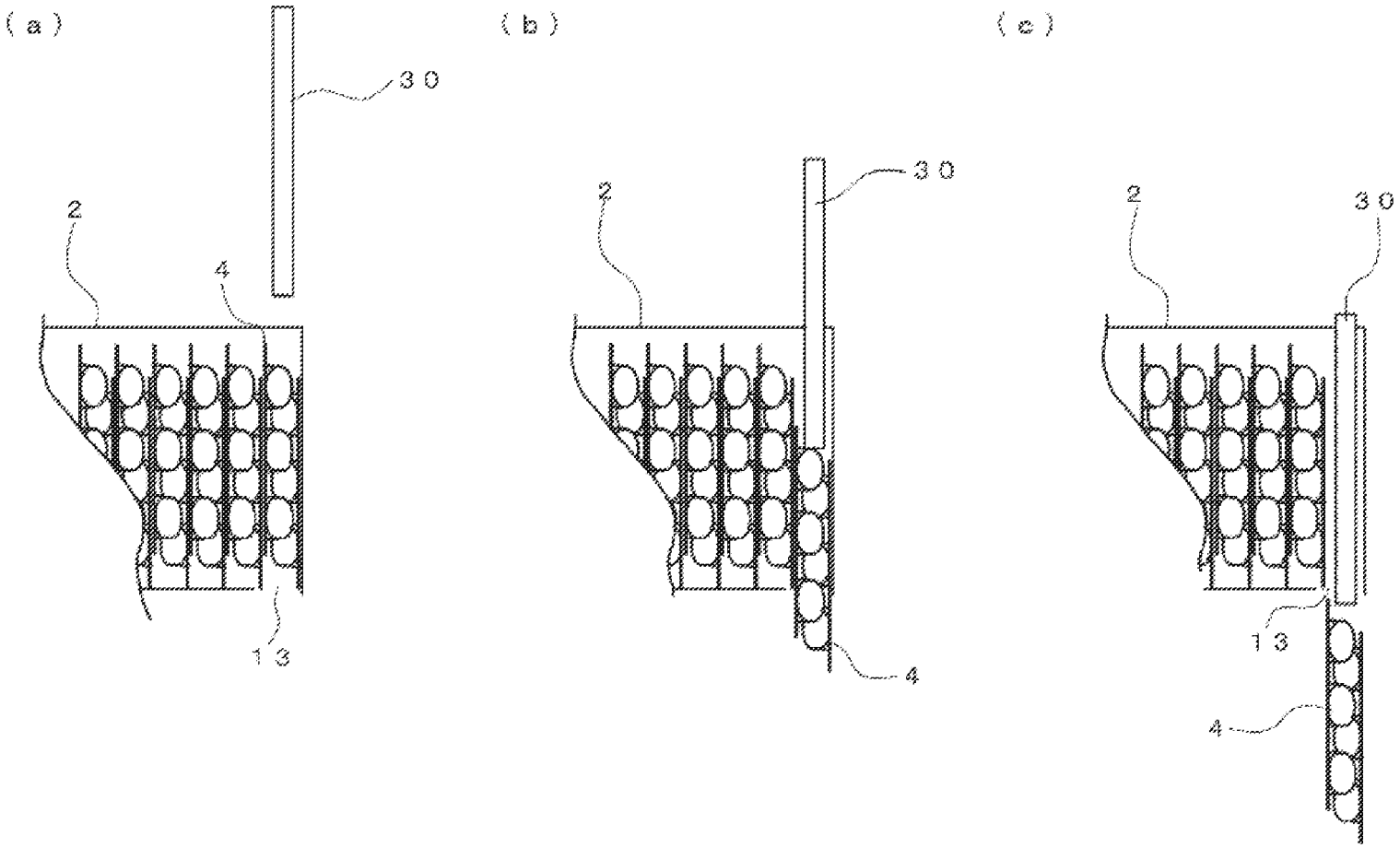
FIG. 18 is a schematic side view showing a dispensing operation of dispensing two blister packages at once from a cassette by the pressing part of FIG. 11.

Further, it is also possible to provide a configuration of dispensing two sheets of a blister package 4 simultaneously as shown in FIG. 18. In this case, it is preferable that the protruding sides of the tablet accommodating part of the blister package 4 are in mutual contact. In particular, by shifting the position of the protruding sections (the pocket part) between the blister packages 4, it becomes easier to transport two blister packages 4 integrally. Usually, when delivered by a pharmaceutical manufacturer, two blister packages 4 are supplied in the box in such a tied state. Thus, the blister packages 4 can be set as is directly after retrieving them from a delivered box.

When setting blister packages 4 in such a state, the pressing part 30 may simply be configured such that the bottom surface can press down two blister packages 4. In FIG. 18, by making the pressing part 30 a flat plate, its bottom surface can press down pockets which are overlapped with positional misalignment. Moreover, the gap of the outlet 13 of the cassette 2 is set to a value such that two blister packages 4 can pass through. By this, when the pressing part 30 is moved downwardly from the state shown in FIG. 18 (*a*), the two blister packages 4 are pressed down by the bottom surface and discharged from the outlet 13 as shown in FIG. 18 (*b*). Then, in a state where two blister packages 4 are discharged completely through the outlet 13 as shown in FIG. 18 (*c*), among the blister packages 4 that were biased towards the front side in the cassette 2, the next blister package 4 positioned at the top will contact the inner surface of the pressing part 30. Accordingly, it is preferable to provide a configuration to prevent a blister package 4 and the pressing part 30 moving together in the upward direction by minimizing the area of contact with the blister package 4 by providing a protrusion or ridge in the inner surface of the pressing part 30. In addition, it is preferable to form a ceiling in the upper surface of the cassette 2 to prevent the next blister package 4 from moving upward.

When using a cassette 2 having a configuration to dispense a blister package 4 by the pressing part 30 as shown in FIG. 18, it is possible to dispense only fractions (including only one sheet) from the aforementioned cassette 2 shown in FIG. 4 etc. That is, the same type of blister packages 4 are loaded in these two types of cassettes 2, and two sheets each may be rapidly dispensed from cassette 2 of the type shown in FIG. 18, and only fractions (including only one sheet) may be dispensed from the cassette 2 shown in FIG. 4, etc. With this, a significant improvement in the working efficiency can be achieved.

Further, in the above-mentioned embodiment, the holding piece 19 was rotated by the attraction force of the magnet 52 provided in the gripping member 24 as an action part without an actual contact, but it is also possible to provide a configuration in which, instead of providing the magnet 52, a lock piece or the like contacts the holding piece 19 to directly rotate the holding piece 19. Further, although a plate-shaped holding piece 19 was used as a holding part, any form can be used as long as it is able to hold the blister package 4.

3. Other Embodiments

The present invention is not limited to the configuration described in the above embodiment, and various modifications are possible within the scope of technical matters that are described in the claims.

3-1. Embodiment 2

In the embodiment mentioned above, the position of the cutting member 25 was changed with respect to a blister package 4 gripped in the gripping member 24 by rotating the rotating plate 56, but it is also possible to change the position of a blister package 4 gripped in the gripping member 24 with respect to the cutting member 25 by rotating the gripping member 24, or rotating both the cutting member 25 and the gripping member 24.

3-2. Embodiment 3

The pressing part 30 may also have the following configuration.

Namely, instead of providing an elastic piece 34, it is also possible to provide a configuration comprised of a plate material and a biasing member for biasing this plate material. It is preferable that the plate material be made of a resin, but it may also be made from a metal etc. As the biasing member, a variety of materials such as urethane rubber, coil spring etc. can be used. By configuring with a plate material and biasing member, the durability can be improved compared to the case of using a plate spring.

3-3. Embodiment 4

Figure 19:
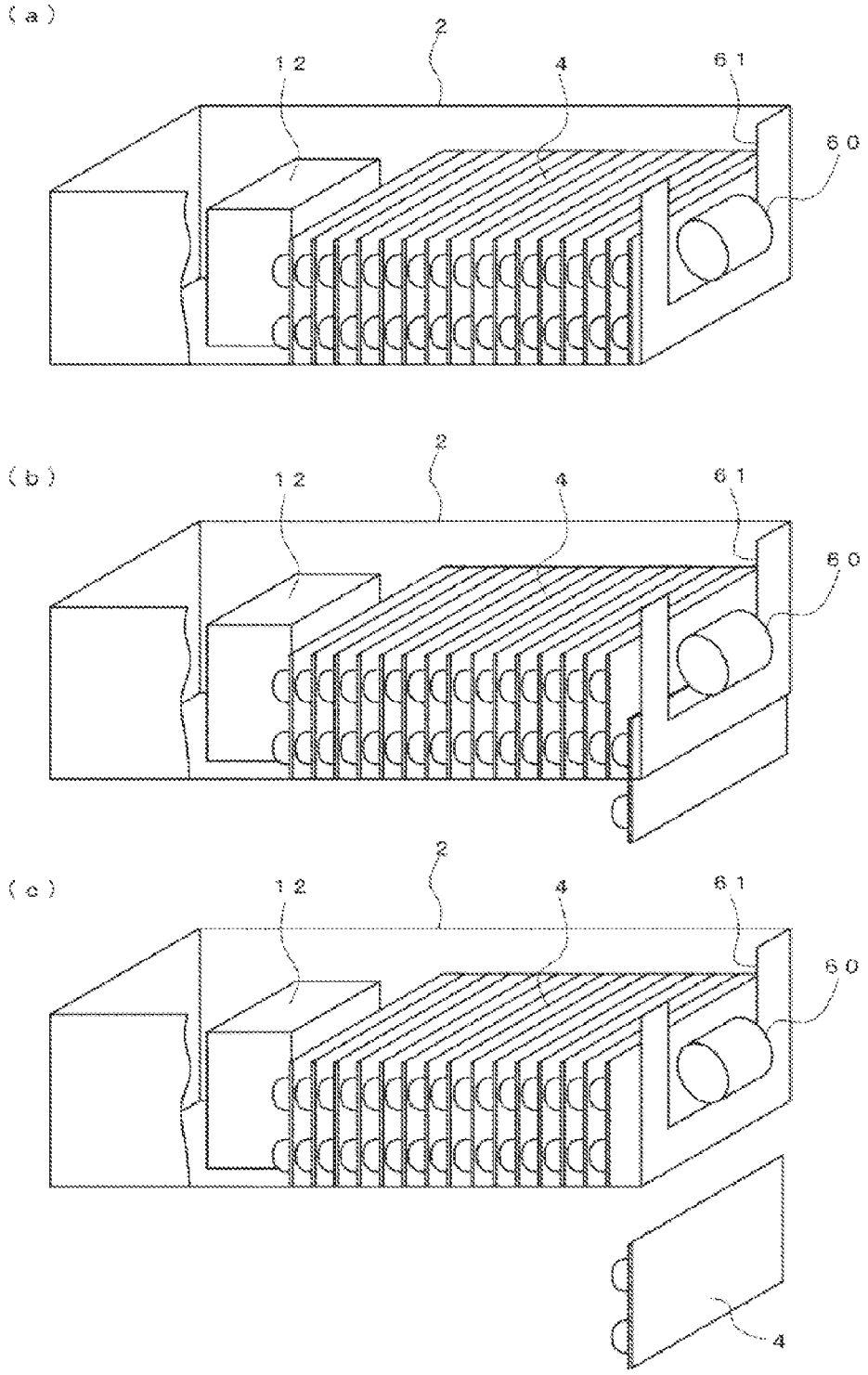
FIG. 19 is a schematic explanatory diagram showing dispensing by a dispensing member of the medicine dispensing device according to another embodiment.

The dispensing member 3 may also be configured with a roller part instead of the holding piece 19 formed by a plate spring. For example, as shown in FIG. 19, it is possible to integrate a rubber roller in the circumference of the rotating shaft as a roller member 60 so that it can rotate. In addition, notch 61 (or an opening) is formed in the vertical direction in the front plate 9*a* of the cassette body 9, and through this notch 61, the roller member 60 is pushed against the blister package 4 that is positioned at top. Thereupon, by driving and rotating the roller member 60, this blister package 4 is dispensed in the lower direction through the outlet 13.

3-4. Embodiment 5

A fraction of the blister package 4 was made to be held in the guide reception part 17 in a state where opening/closing door 10 is rotated by 180 degree, but it is also possible to provide, without need to rotate the opening/closing door 10, a storage part that can store a fraction of the blister package 4. Blister packages 4 can be conveyed to the storage part by the gripping member 24.

3-5. Embodiment 6

Cassette 2 and pressing part 30 may be configured as shown in FIG. 20 through FIG. 28.

Figure 20:
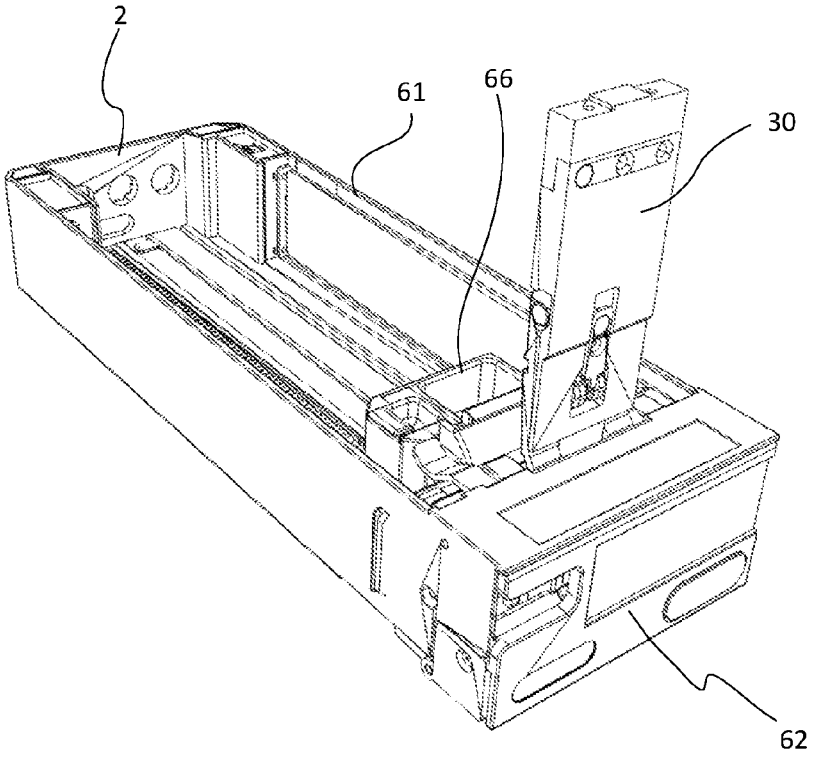
FIG. 20 is a perspective view of a cassette and pressing part of the 6th embodiment.
Figure 21:
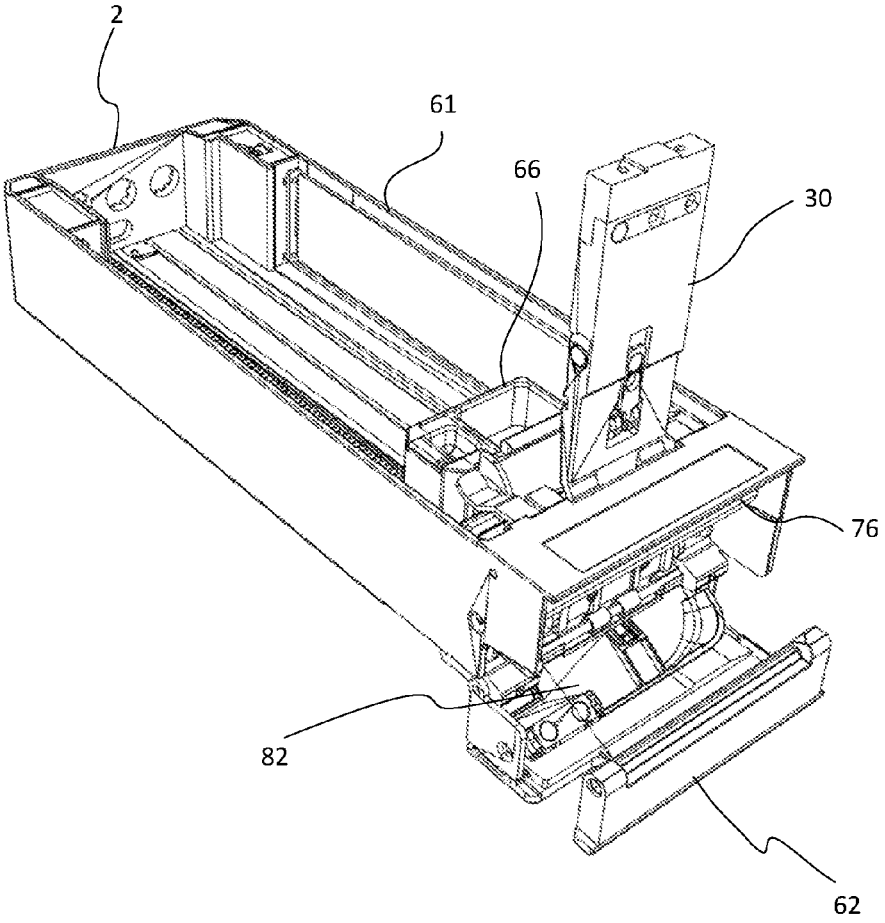
FIG. 21 is a perspective view showing a state wherein the opening/closing door from FIG. 20 is rotated by 90°.

In the same way as the embodiment 1, cassette 2 is configured from a cassette body 61 and an opening/closing door 62, as shown in FIG. 20 and FIG. 21.

Figure 22:
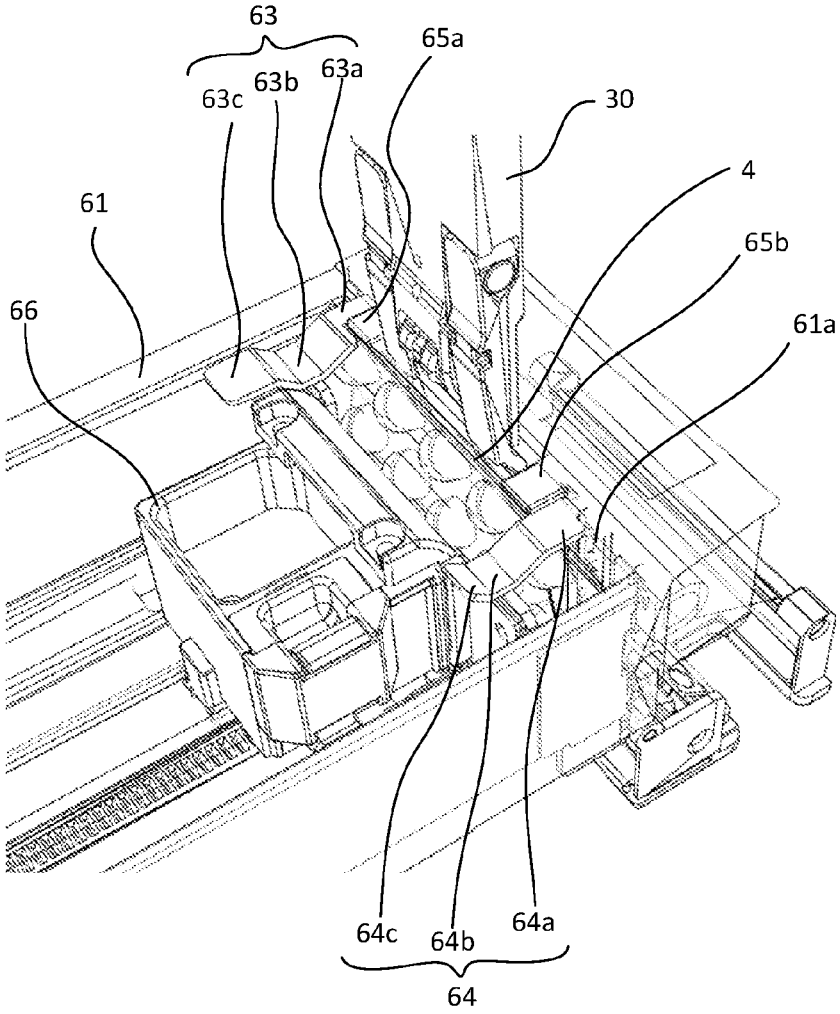
FIG. 22 is a magnified perspective view of the top section of the cassette of FIG. 21 viewed from a different angle.

Cassette body 61, as shown in FIG. 22, is provided with a pair of pressing pieces (first pressing piece 63 and second pressing piece 64) protruding toward the inside of the cassette body 61 from both sides of top end of a front plate 61*a*, and guide parts 65*a* and 65*b* disposed inside the pressing pieces 63 and 64 respectively. One guide part 65*a* is disposed in the notch section of the base section of the first pressing piece 63. Further, the first pressing piece 63 is configured from a first horizontal portion 63*a* protruding in the horizontal direction towards the inside of the cassette body 61, a second horizontal portion 63*b* that orients obliquely downwards from the first horizontal portion 63*a* and extends in the horizontal direction in the end section, and a guide part 63*c* that orients obliquely upwards from the second horizontal portion 63*b* and extends in the horizontal direction. The second pressing piece 64, similarly to the first pressing piece 63, is provided with a first horizontal portion 64*a* and a second horizontal portion 64*b*, and a guide part 64*c* consists of only an inclining part extending in the upward direction. The rear side of the guide parts 65*a* and 65*b* are fixed to a front plate 61*a*, and a curved surface 65*c* (see FIG. 24) similar to Embodiment 1 is provided in the front surface, and guides a bent blister package 4.

Figure 23:
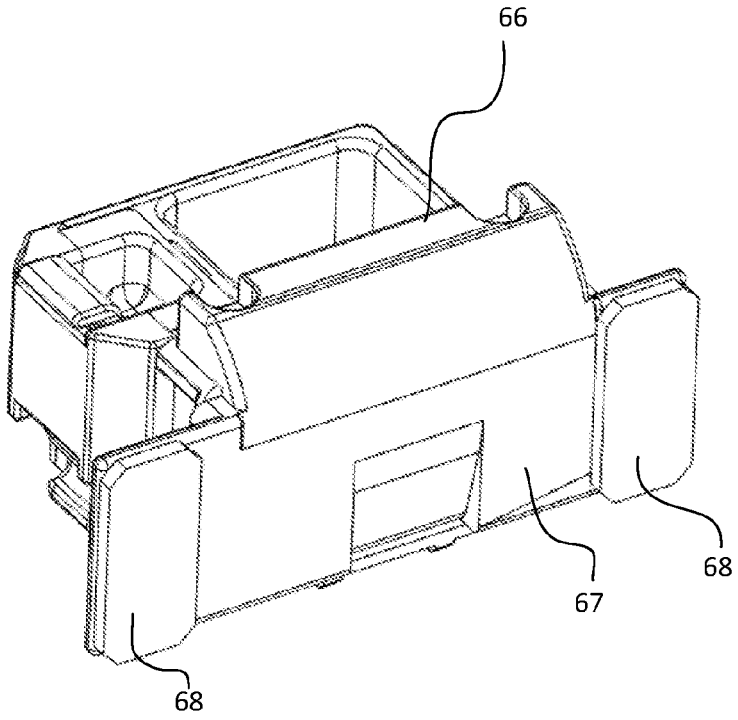
FIG. 23 is a perspective view showing a pushing member of FIG. 22.

In the cassette body 61, as shown in FIG. 22, more specifically in FIG. 23, pushing member 66 is disposed so as to move in the front and back directions. Although the pushing member 66 has the substantially same configuration as Embodiment 1, it differs with regard to the following points.

Namely, the pushing member 66 consists of a pushing plate 67, which is provided in the front side for pushing a blister package 4 and extends in the width direction of the cassette body 61, and at its both ends are attached pushing pads 68 made of a material of high friction coefficient (e.g. urethane rubber etc.). The pushing pads 68 come in contact with the blister package 4, and prevent its positional deviation. In particular, when the remaining quantity of the blister package 4 in the cassette body 61 becomes two, dispensing two blister packages together is effectively prevented when dispensing the top first one.

Figure 24:
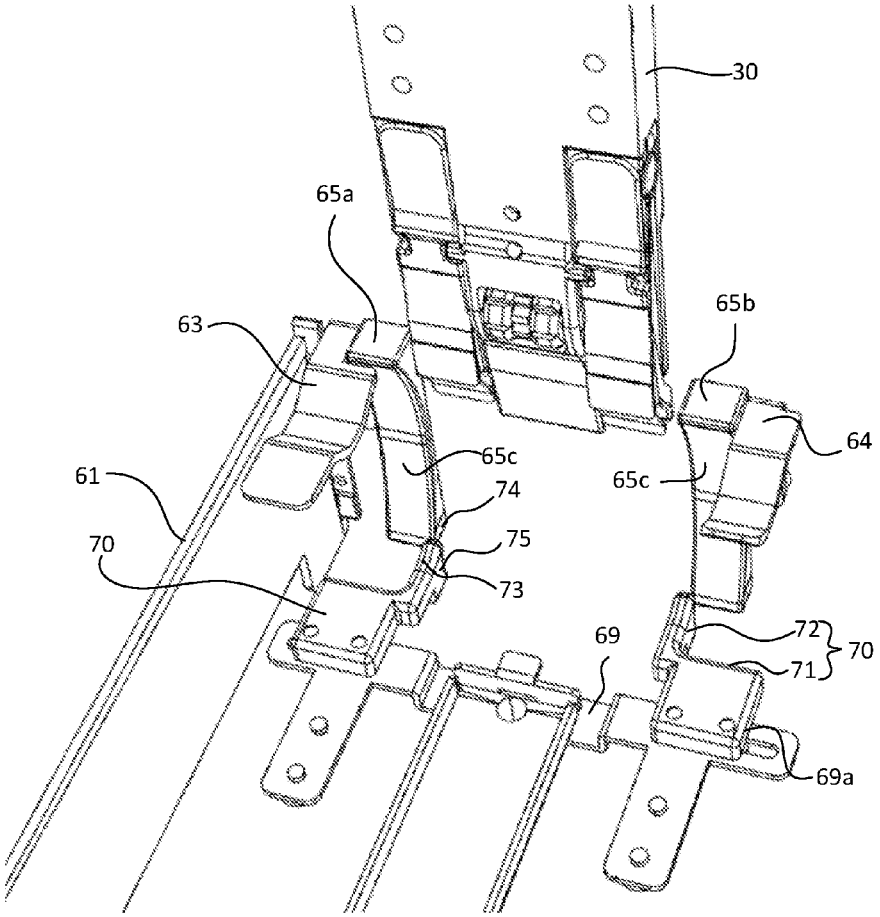
FIG. 24 is a perspective view showing the cassette of FIG. 22 in which a part of the cassette has been removed.

On the bottom side of the cassette body 61, as shown in FIG. 24, a support plate 69 extending in the width direction is disposed, and at a predetermined interval therein, a pair of guide plates 70 are attached. The support plate 69 has an elongated hole 69*a* such that the fixing position of each guide plate 70 can be adjusted in the width direction of the cassette body 61. With this, the position of each guide plate 70 can be adjusted according to the width dimension of a blister package 4 that varies with medicine, and a blister package 4 can be guided between the guide plates 70 (more specifically, the sheet part of the blister package 4 is guided by the guide plates 70). Each guide plate 70 is configured of a mounting table 71 that is positioned in the support plate 69, and a guide piece 72 extending therefrom. The guide piece 72 is configured of a first curved part 73 that gradually bends upwards toward the end, an inclined section 74 formed in an tip section of the first curved part 73 and cut obliquely downwards, and a second curved part 75 extending downwards from the inclined section 74. The second curved part 75 gradually projects in the front direction (towards front plate 61*a*) toward the lower end, and in the closest position, the gap with the front plate 61*a* is of a size such that only the sheet section of a blister package 4 can pass through. With this, when dispensing the top first blister package 4 from the cassette body 61, it is possible to prevent dispensing the second blister package 4 together.

Figure 26:
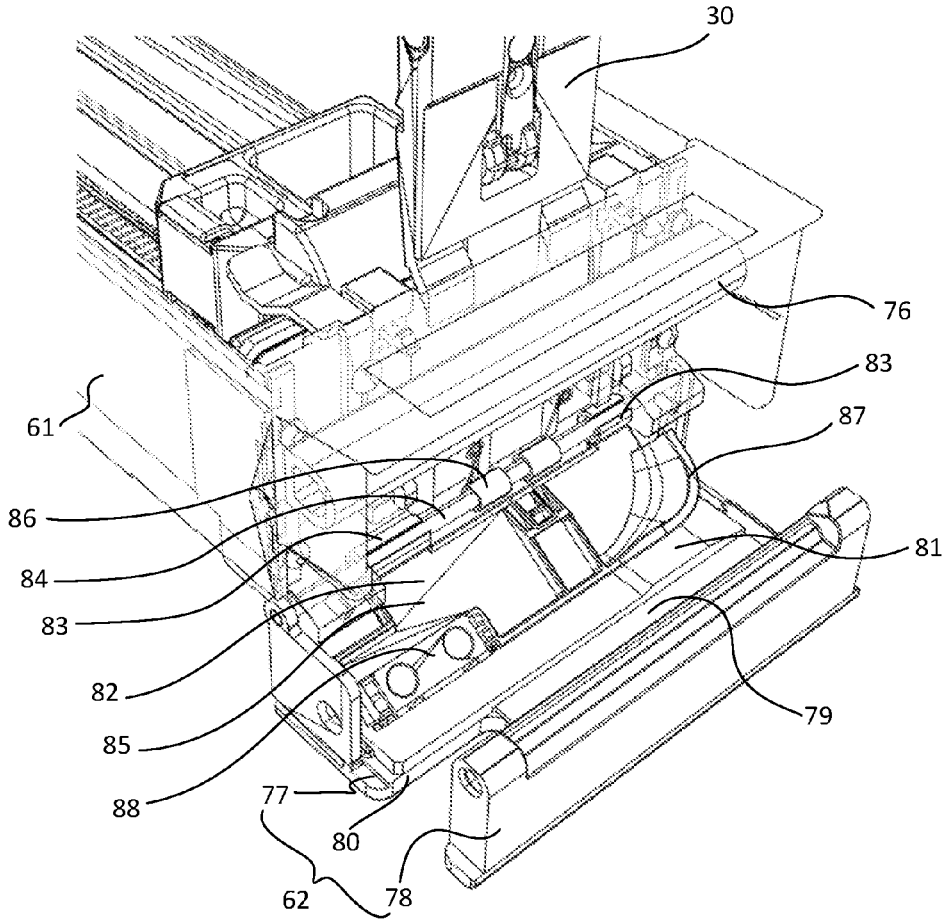
FIG. 26 is a magnified side view of top section of the cassette of FIG. 21.

Furthermore, as shown in FIG. 21 and FIG. 26, projecting member 76 is provided in the front side of the cassette body 61. The projecting member 76 is cylindrical in shape and the projecting surface is a curved surface of arcuate cross-section. The projecting member 76 is fabricated from an elastic material such as synthetic rubber, and can contact the blister package 4. Thereupon, when the opening/closing door 62 is closed in the front side of the cassette body 61, the lower end of the blister package 4 is held by the holding piece 82, which is described later, while the upper end is held by the projecting member 76. Therefore, regardless of the existence of the notch 80 in the opening/closing door 62, the blister package 4 can be securely held. In particular, even if the holding piece 82 is released by inserting a finger through the notch portion 80, it is possible to keep holding the blister package 4.

As shown in FIG. 26, the opening/closing door 62, similarly to Embodiment 1, is configured of a front surface portion 77, and a guide receiving unit 78 extending vertically from the front edge of this front surface portion 77. In the inner surface of the front surface portion 77, a groove portion 79 is formed along the guide receiving unit 78, and a projection 81 is formed opposite to the notch portion 80 near the groove portion 79.

The opening/closing door 62 is provided with a holding piece 82. The holding piece 82 is obtained by molding a synthetic resin material into a rectangular plate shape in a plan view. A bearing part 83 of substantially C-shaped cross section is formed in two places on one long side (side edge) of the holding piece 82. Holding piece 82 is rotatably attached by rotatably mounting on a spindle 84 provided in the lower end of the front surface portion 77 by elastically deforming the bearing portion 83. In the holding piece 82, three sides are projecting except the side edge having the bearing portion 83, and in its inside a recess 85 is formed. In the middle section of the recess 85, between both bearing portions 83, a part of a spring 86 attached to the spindle 84 is locked. With this, the holding piece 82 contacts the front surface portion 77 of the opening/closing door 62, and a blister package 4 can be held between them. A guiding guide part 87 is formed at the corner of one end of the holding piece 82. The guiding guide part 87 is configured from a curved surface bulging gradually towards the front surface portion 77 from the arc edge of the arc in a plan view. In addition, the corner of the other end of the holding piece 82 is provided with an attracted plate 88 made from a magnetic material.

Figure 27:
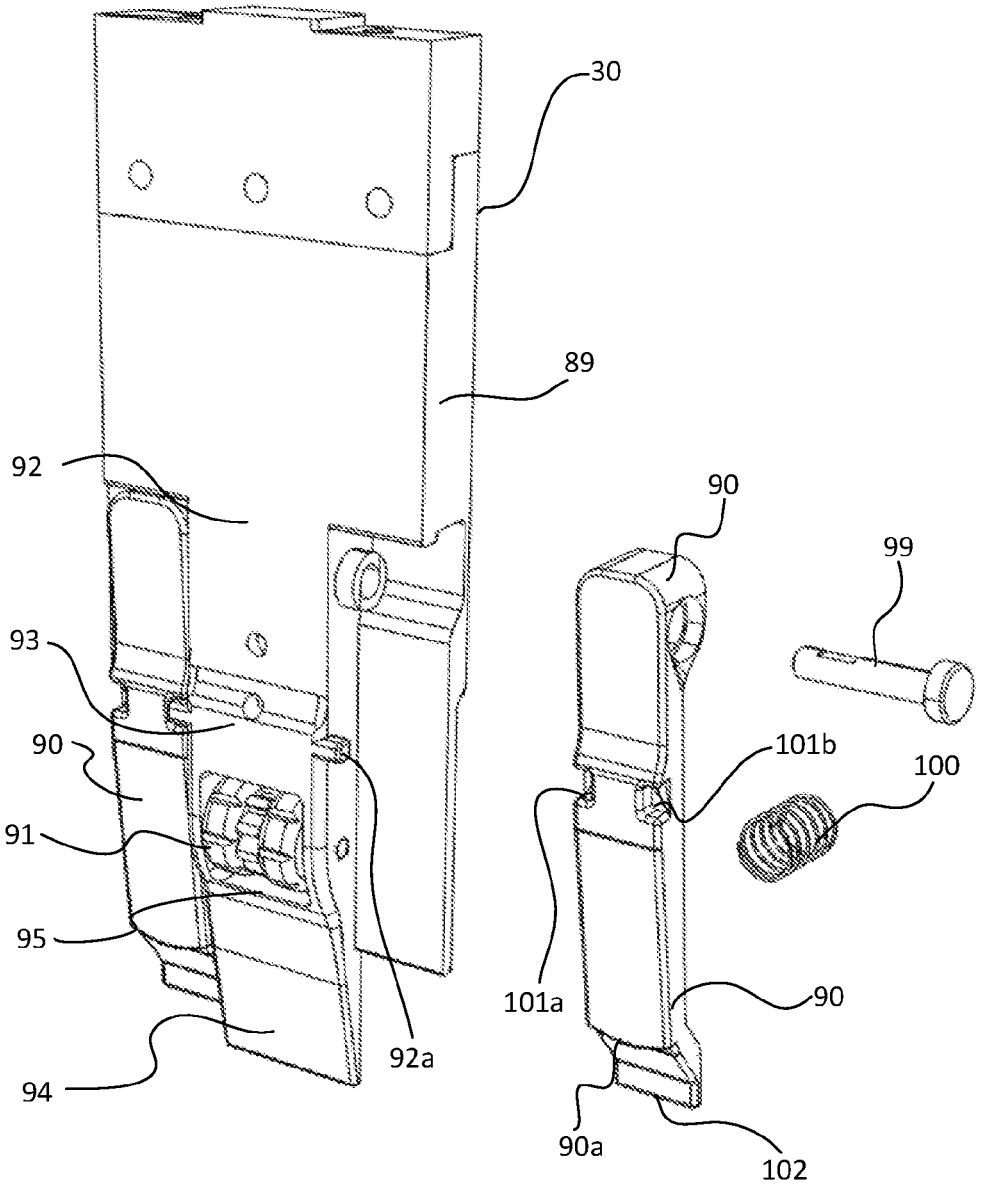
FIG. 27 is a partial exploded perspective view showing the pressing part of FIG. 20.
Figure 28:
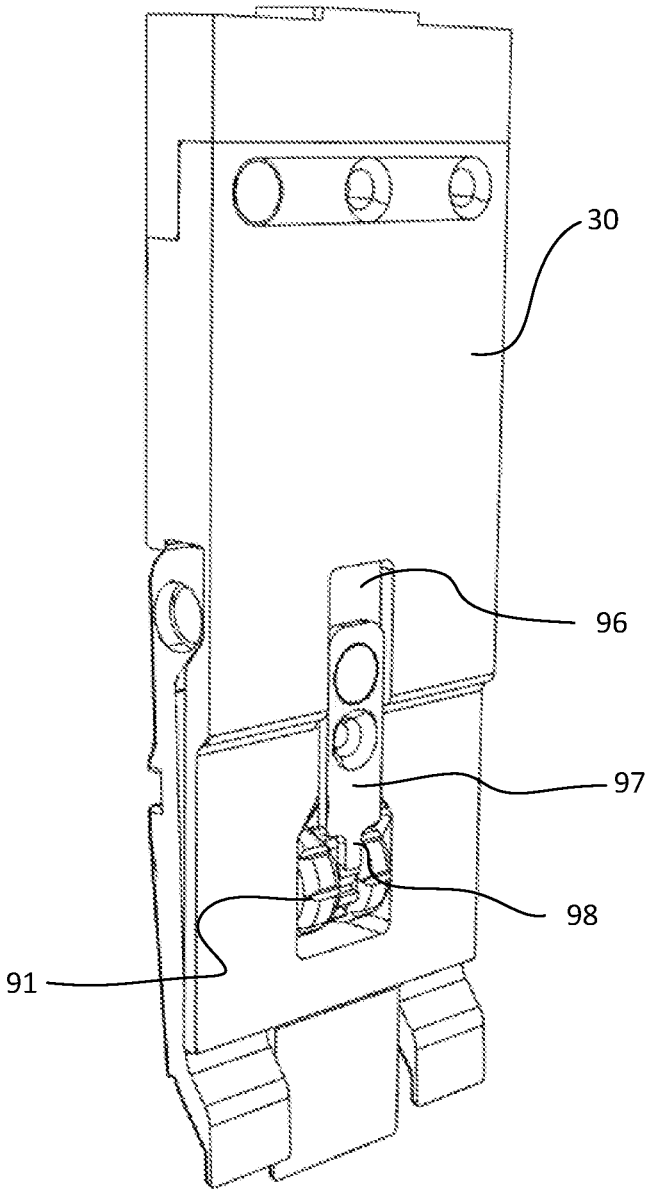
FIG. 28 is a perspective view of the pressing part of FIG. 20 as seen from opposite side.

As shown in FIG. 27 and FIG. 28, the pressing part 30 is provided with a press-down piece 90 provided on both sides of the lower section of the body plate 89, and a roller part 91 provided in the lower middle portion of the body plate 89.

In the body plate 89, as shown in FIG. 27, of the rear and front sides, the rear side is formed of a flat surface, and the front side is provided with a projecting part 92, excluding the top end section, by forming a depression on both sides respectively. In the projecting part 92, a thick part 93 of large thickness is formed in the middle part, and an inclined section 94 is formed in the lower direction therefrom such that the lower portion gradually becomes thinner in the rear side towards the lower end. The tip of the inclined section 94 further projects from the lower end of the body plate 89. In the thick part 93, a rectangular opening 95 is formed to connect from the front surface to the rear surface of the body plate 89. As shown in FIG. 28, a recessed part 96 extending vertically is formed in the middle of rear surface of the body plate 89, and a lock piece 97 is fixed therein. In the lock piece 97, a narrow-width locking part 98 is projecting from the lower end, and this locking part 98 can be locked with each gear 106 of the locking gear part 103 of the roller part 91, which is described later.

The press-down piece 90, as shown in FIG. 27, is configured from strips of plate material made of a synthetic resin material. Each press-down piece 90 is disposed in the respective depressed sections formed on both sides of the projecting part 92 of the body plate 89. Each press-down piece 90 is supported in the upper section of the projecting part 92 so as to be able to rotate around the spindle 99, and is biased towards the front direction by a spring 100 (although not illustrated, a recess wherein one end of the spring 100 is disposed is formed in the press-down piece 90). In the middle section of each press-down piece 90, recessed parts 101*a* and 101*b* are respectively formed in each side of the front side. A projection 92*a* projecting from the projecting part 92 is located in one recessed part 101*a* (on the side of projecting part 92), and restricts the rotational range of the press-down piece 90. In addition, the other recessed part 101*b* is intended for making the left and right press-down piece 90 the same part. The bottom end of each press-down piece 90 is provided with a lock piece 90*a*, and a thin part 102 that gradually bends towards the rear surface and a tip thereof further extends downwards.

Figure 29:
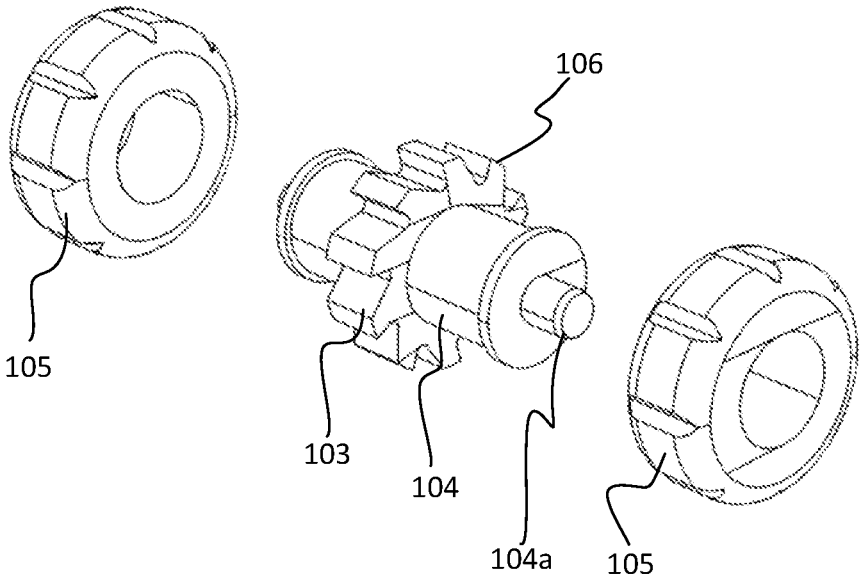
FIG. 29 is a partial exploded view showing the roller part of the pressing part of FIG. 27.

The roller part 91, as shown in FIG. 29, consists of a cylindrical body 104 provided with a locking gear part 103 in its outer circumference, and a pair of rotating rollers 105 disposed on both sides of the locking gear part 103. The roller part 91 is disposed within the opening 95 formed in the projecting part 92 of the above-mentioned body plate 89, and is rotatably supported by a spindle 104*a* having the cylindrical body 104 therein. The locking gear part 103 consists of a plurality of gears 106 that are inclining towards one circumferential direction of the cylindrical body 104. The locking part 98 of the lock piece 97 provided in the body plate body 89 engages with each gear 106 so that the roller part 91 can rotate in only one circumferential direction (works similarly to one-way clutch). A rotary roller 105 is rotatably mounted integrally in the outer circumference of the cylindrical body 104. However, by the application of a force more than necessary, it idles by shifting the position with the cylindrical body 104. Here, the force acting on the rotary roller 105 when idling is made such that the rotary roller 105 does not damage the blister package 4 that is in contact.

According to the above configuration, when dispensing a blister package 4 from the cassette 2, if the pressing part 30 is lowered from the initial position, the top edge of the top (first) blister package 4 positioned at the top of the cassette 2 is pressed down by engaging with the lock piece 90 formed in the press-down piece 90. In this case, even if the blister package 4 is assumed to be curved, since the press-down piece 90 is provided such that it can rotate in a state biased by the spring 100, the lock piece 90*a* can be securely locked to its top edge. With this, the first blister package 4 will be dispensed through the opening 95 of the cassette 2. Here, only the rotary roller 105 is in contact with the next (second) blister package 4, and this rotary roller 105 will move on the flat surface of the second blister package 4. Due to this, even though the pressing part 30 is lowered, a force towards the lower side is unlikely to act on the second blister package 4. Further, the gap between the front plate formed by the guide plate 70 is set to a value such that only one blister package 4 will be able to pass through as described above. Therefore, it will be difficult for the second blister package 4 to move to the lower side together with the pressed-down first blister package 4, and will not be dispensed from the opening 95.

Also, when the pressing part 30 is raised, only the rotary roller 105 will come in contact with the second blister package 4. Here, because the locking part 98 of the lock piece 97 of the body plate 89 engages with any of the gears 106 of the locking gear part 103 of the cylindrical body 104, the rotary roller 105 will be prevented from rotating. Therefore, an upward force will act on the second blister package 4 through the rotary roller 105. Due to this, even if the second blister package 4 is deviating in the dispense direction when the first blister package 4 is dispensed, the position is corrected in the upper direction. In this case, if an unreasonable force acts on the blister package 4 from the rotary roller 105, since the rotary roller 105 rotates idly with respect to the cylindrical body 104, it is unlikely that the blister package 4 will be damaged. The movement of the blister package 4 in the upper direction is restricted by the respective first horizontal portions of the first pressing piece 63 and the second pressing piece 64 provided in the cassette body 61.

Figure 25:
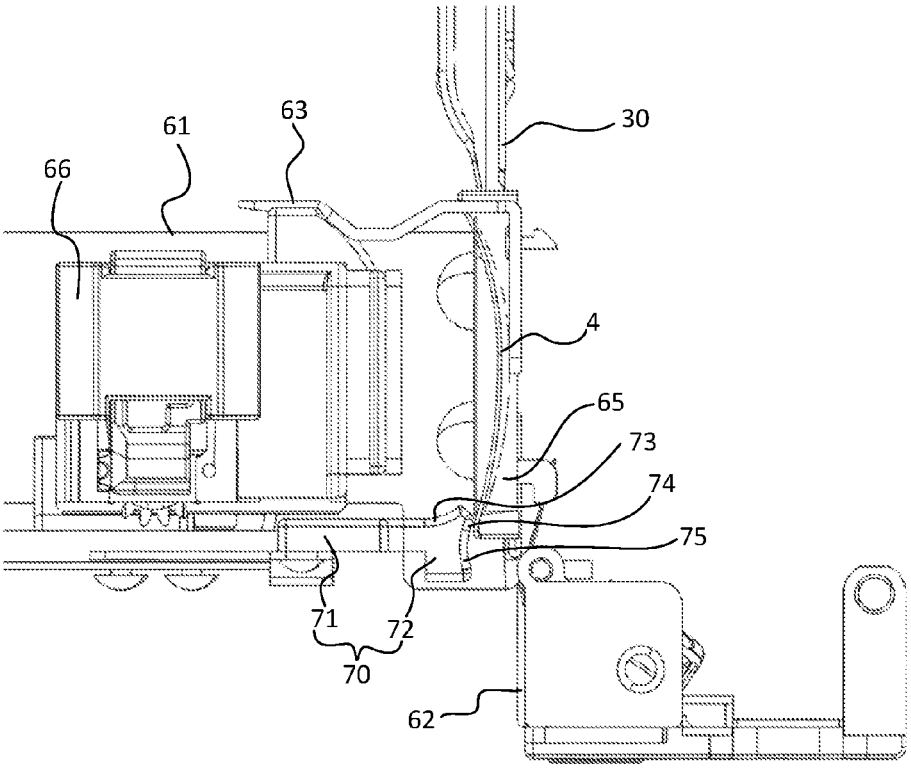
FIG. 25 is a magnified perspective view of top section of the cassette of FIG. 21.

When the pressing part 30 returns to the initial position, the blister packages 4 in the cassette body 61 will move forward due to the pushing member 66. Here, the lower edge of the top blister package 4 is moved along the first curved part 73 of the guide piece 72, and there will be positional displacement in the vertical direction between the blister packages 4. Then, only the top first blister package 4 will ride over the first curved part 73 and reaches the inclined section 74, and moves to the second curved part 75. In this case, similarly to Embodiment 1 described above, even if a blister package 4 is bent, since a curved surface 65*c* is formed in the guide parts 65*a* and 65*b* fixed to the front plate, only the top first blister package 4 will move to a position where it can be dispensed from the cassette body 61. Thereupon, the blister package 4 bends in a direction opposite to the curved surface 65*c* when passing through the second curved surface 75, and the bent shape is corrected so as to become flat. The positional relationship between the guide plate 65 and guide piece 72 is set such that a blister package 4 cannot pass through unless the sheet part is bent. That is, as shown in FIG. 25, the position of the inner lower end of the guide plate 65 and the boundary position between the inclined part 74 of the guide piece 72 and the second curved part 75 are disposed so as to overlap with each other. With this, unless pressed down by the pressing part 30, the dispensing of a blister package 4 is prevented. Further, even when pressed down by the pressing part 30, a simultaneous dispensing of two blister packages 4 (overlapped dispatch) is prevented. Thereafter, by rising/lowering the pressing part 30, only the required quantity of a blister package 4 is dispensed in the same way as the above.

When dispensing a fraction of a blister package 4 from a cassette 2, the opening/closing door 62 is opened and positioned in the fraction dispensing position. If there is no blister package 4 held in the opening/closing door 62, as in the same way as the above, by lowering the pressing part 30, only one blister package 4 can be supplied from the cassette body 61 to the inside of the opening/closing door 62 positioned at the fraction dispensing position. At the opening/closing door 62, the holding piece 82 is biased toward the front surface portion 77. Therefore, a supplied blister package 4 is sandwiched between the holding piece 82 and the front surface portion 77 of the opening/closing door 62. A guiding guide part 87 is formed at the corner section of the holding piece 82, and the holding range of the blister package 4 becomes narrower, but a projection 81 is formed in the front surface portion 77 and the holding pressure with the holding piece 82 is increased. Therefore, even though the holding range is narrow, the holding state of a blister package 4 becomes almost same as the other section. As a result, a blister package 4 can be held suitably without tilting in the gap between the holding piece 82 and front surface portion 77.

A blister package 4 held between the holding piece 82 and front surface portion 77 drives a gripping member 24 and moves it to the opposite to the notch portion 80 to cut a fraction with the help of the cutting member 25 and dispense it, similarly to Embodiment 1. The blister package 4 from which a fraction has been cut is moved to the original position by the gripping member 24. Although a blister package 4, at the time of cutting a fraction, may deform or tilt with respect to the gripping member 24, it will smoothly move into the space between the holding piece 82 and the front surface portion 77 since a guiding guide part 87 is formed in the holding piece 82.

Once the dispensing of a fraction from the blister package 4 is completed, the opening/closing door 62 is rotated from the fraction dispensing position to a closed position. Here, the projecting member 76 provided in the cassette body 61 contacts the fraction of the blister package 4, and the blister package 4 is sandwiched between the opening/closing door 62. Further, in case of the blister package 4, the pocket part of one column is positioned inside the groove portion 79 of the opening/closing door 62, and positional deviation in the width direction is prevented. Because of this, in a state wherein the opening/closing door 62 is moved to the closed position, the holding state of a blister package 4 can be stabilized.

Other Embodiment

A medicine dispensing device can also be configured as follows. That is, a medicine dispensing device can be configured by providing: a device body; a storage container wherein a plurality of blister packages in which medicine is individually packed are stored in a stacked manner; a dispensing member that is provided movably in the device body and that moves to the storage container to dispense a stored blister package, and wherein the above-mentioned dispensing member is provided with a roller part that contacts the next blister package and rotate when retrieving the above-mentioned blister package from the outlet of the storage container.

With this configuration, when removing the top blister package from the storage container, the roller part will roll to the next blister package, and will not generate a large frictional force in the retrieval direction. Therefore, it is possible to smoothly take out only the top blister package.

It is preferable that the dispending member be provided with a locking mechanism to prevent rotation of the roller part that is in contact with the next blister package when moving in the direction opposite to the retrieval direction after retrieving the blister package from the outlet of the storage container.

With this configuration, when returning the dispensing member to the initial position, the roller part is prevented from rotating due to the locking mechanism, and therefore, a friction force between the roller part and the next blister package becomes large. Hence, a next blister package can be surely returned to the original position to prepare for the next dispensing operation.

A medicine dispensing device is configured by including: a device body; a storage container wherein a plurality of blister packages in which medicine is individually packed are stored in a stacked manner; and a dispensing member that is provided movably in the device body and that moves to the storage container to dispense a stored blister package, wherein the storage container is provided with an outlet in a direction perpendicular to the pressing direction with respect to the blister package pressed towards one end, and a guide plate for guiding the side edge of the blister package is provided near the above-mentioned outlet, wherein the guide plate includes: a curved part that gradually changes the guide position in a direction opposite to the outlet as the blister package approaches the pressing direction; and an inclined part that is continuous with the curved part and inclines towards the outlet.

With this configuration, the position in a direction perpendicular to the pressing direction of the adjacent blister package can be shifted at this curved part, and further, only the top of a blister package can be separated in the inclined section and sent towards the outlet. Due to this, only the top blister package can be smoothly dispensed from the outlet.

A medicine dispensing device is configured by including: a device body; a storage container wherein a plurality of blister packages in which medicine is individually packed are stored in a stacked manner; a dispensing member that is provided movably in the device body and that moves to the storage container to dispense a stored blister package, and wherein the storage container is provided with an opening/closing door that can rotate to a dispensing position where a blister package can be retrieved from the outlet, and to a fraction dispensing position wherein a blister package dispensed from the above-mentioned outlet can be held, and wherein the opening/closing door is comprised of a holding piece for holding a blister package dispensed from the outlet at the fraction dispensing position by pressing a part of the blister package against the opening/closing door, and wherein the holding piece is provided with a guiding guide part, at the position of loading/withdrawing the blister package, that is formed so as to gradually separate from the blister package in the transport direction of the blister package.

With this configuration, when loading and withdrawing a blister package from the opening/closing door for cutting a fraction from a blister package held in the opening/closing door by a holding piece, even if the blister package is distorted by cutting etc., the blister package can be smoothly loaded and withdrawn due to the existence of the guiding guide part.

It is preferable that the storage container is provided with a positioning guide part for positioning by pressure-contacting the held blister package when the opening/closing door is rotated in the dispensing position.

With this configuration, the position deviation of a blister package held in the opening/closing door can be surely prevented, and when dispensing the next fraction, the loading and withdrawal of a blister packages through the opening/closing door can be carried out smoothly.

It is preferable that the above-mentioned opening/closing door is provided with a recess at a location opposite to the guide part when rotated in the dispensing position.

With this configuration, it is possible to prevent the positional deviation of a blister package held in the opening/closing door with more certainty.

EXPLANATION OF NUMBERS

1 . . . Device body
2 . . . Cassette (storage container)
3 . . . Dispense member
4 . . . Blister package
5 . . . Frame
6 . . . External panel
7 . . . Transport device
8 . . . Cassette mounting part
9 . . . Cassette body
9*a* . . . Guide surface
9*b* . . . Curved surface
9*c* . . . Guide surface part
9*d* . . . Lock hole
9*e* . . . Guide hole
10 . . . Opening/closing door
11 . . . Guide groove
12 . . . Pushing member
13 . . . Outlet
14 . . . Recess
15 . . . Bearing part
16 . . . Front surface portion
17 . . . Guide receiving unit
18 . . . Notch portion
19 . . . Holding piece
20 . . . Attracted part
21 . . . Support plate
22 . . . First dispensing member
23 . . . Second dispensing member
24 . . . Gripping member
25 . . . Cutting member
26 . . . Recovery member
27 . . . Vertical rail
28 . . . Horizontal rail
29 . . . Rack
30 . . . Pressing part

31 . . . Arm
32 . . . Front plate
33 . . . Rear part
34 . . . Elastic piece
35 . . . Lock piece
36 . . . Guide part
37 . . . Drive mechanism
38 . . . Mounting plate
39 . . . Motor
40 . . . Drive gear
41 . . . Intermediate gear
42 . . . Driven gear
43 . . . Rotating pin
44 . . . Driven plate
45 . . . Operating hole
46 . . . Guide pin
47 . . . Gripping piece
48 . . . Guide plate
49*a* . . . First curved surface
49*b* . . . Second curved surface
50 . . . Gripping part
51 . . . Light sensor
52 . . . Magnet
53 . . . Fulcrum
54 . . . Fixed blade
55 . . . Movable blade
56 . . . Rotating plate
57 . . . Guiding path
58 . . . Recovery container
61 . . . Cassette body
62 . . . Opening/closing door
63 . . . First pressing piece
64 . . . Second pressing piece
65 . . . Guide part
66 . . . Pushing member
67 . . . Pushing plate
68 . . . Pushing pad
69 . . . Support plate
70 . . . Guide plate
71 . . . Mounting table
72 . . . Guide piece
73 . . . First curved part
74 . . . Inclined part
75 . . . Second curved part
76 . . . Projecting member
77 . . . Front surface portion
78 . . . Guide receiving unit
79 . . . Groove portion
80 . . . Notch portion
81 . . . Projecting part
82 . . . Holding piece
83 . . . Bearing
84 . . . Spindle
85 . . . Recess
86 . . . Spring
87 . . . Guiding guide part
88 . . . Attracted plate
89 . . . Body plate
90 . . . Press-down piece
91 . . . Roller part
93 . . . Thick part
94 . . . Inclined part
95 . . . Opening
96 . . . Recessed part
97 . . . Lock
98 . . . Lock part
99 . . . Spindle
100 . . . Spring
101 . . . Recessed part
102 . . . Thin part
103 . . . Lock gear part
104 . . . Cylinder shape
105 . . . Rotating roller

The invention claimed is:

1. A medicine dispensing device comprising:
a device body;
a storage container in which a plurality of blister packages in which medicines are separately packed are accommodated in a stacked state; and
a dispensing member movably provided at the device body, the dispensing member moving up to the storage container and dispensing the accommodated blister package,
wherein the storage container includes:
an outlet formed at one end side for taking out the blister package; and
a biasing means that biases the accommodated blister package towards the one end side,
wherein the dispensing member includes:
a guide part for guiding a side edge part of the blister package, wherein the blister package can be biased towards one end side of the storage container by the guide part, and
an elastic piece that is capable of biasing the blister package towards one end side of the storage container, wherein the guide part for guiding the side edge part of the blister package is provided at an end section of the elastic piece.

2. The medicine dispensing device according to claim 1, wherein the storage container further includes a curved surface at an inner side surface of storage container's body that is formed at the one end side located in a biasing direction by the biasing means, said curved surface is depressed in a direction to avoid interference with a curved shape of the blister package.

3. A medicine dispensing device comprising:
a device body;
a storage container in which a plurality of blister packages in which medicines are separately packed are accommodated in a stacked state; and
a dispensing member movably provided at the device body, the dispensing member moving up to the storage container and dispensing the accommodated blister package,
wherein the storage container includes:
an outlet formed at one end side for taking out the blister package; and
a biasing means that biases the accommodated blister package towards the one end side, and
a curved surface at an inner side surface of storage container's body that is formed at the one end side located in a biasing direction by the biasing means, said curved surface is depressed in a direction to avoid interference with a curved shape of the blister package, and
wherein the dispensing member includes:
a guide part for guiding a side edge part of the blister package, wherein the blister package can be biased towards one end side of the storage container by the guide part.

4. The medicine dispensing device according to claim 3, wherein:

the dispensing member further includes an elastic piece that is capable of biasing the blister package towards one end side of the storage container, and the guide part for guiding the side edge part of the blister package is provided at an end section of the elastic piece.

* * * * *